US009962823B2

(12) United States Patent
Machida

(10) Patent No.: US 9,962,823 B2
(45) Date of Patent: May 8, 2018

(54) POWER TOOL

(71) Applicant: MAKITA CORPORATION, Anjo-shi, Aichi (JP)

(72) Inventor: Yoshitaka Machida, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 670 days.

(21) Appl. No.: 14/554,347

(22) Filed: Nov. 26, 2014

(65) Prior Publication Data

US 2015/0144368 A1 May 28, 2015

(30) Foreign Application Priority Data

Nov. 26, 2013 (JP) ..... 2013-244448

(51) Int. Cl.
*B25D 17/24* (2006.01)
*B25F 5/02* (2006.01)
*B25F 5/00* (2006.01)

(52) U.S. Cl.
CPC ..... *B25D 17/24* (2013.01); *B25F 5/006* (2013.01); *B25F 5/02* (2013.01); *B25F 5/026* (2013.01)

(58) Field of Classification Search
CPC . B25D 17/24; B25F 5/006; B25F 5/02; B25F 5/026
USPC ..... 173/213, 162.2
See application file for complete search history.

(56) References Cited

U.S. PATENT DOCUMENTS 4,978,877 A * 12/1990 Quirijnen ..... H02K 23/18 310/229
2009/0266571 A1 10/2009 Baumann et al.
2011/0011608 A1* 1/2011 Saur ..... B25D 11/062 173/162.2

FOREIGN PATENT DOCUMENTS

WO WO 2007/068535 A2 6/2007

OTHER PUBLICATIONS

Mar. 31, 2015 Extended Search Report issued in European Application No. 14194538.6.

* cited by examiner

*Primary Examiner* — Robert Long
*Assistant Examiner* — Xavier A Madison
(74) *Attorney, Agent, or Firm* — Oliff PLC

(57) ABSTRACT

A hammer drill includes a main body which houses a driving motor having a brush and a brush holder unit which holds the brush and switches a position of the brush, and a main handle which is movable to the main body. Further, a coil spring which biases the handle is provided. In a state that the coil spring biases the handle, the handle is moved against the main body in a longitudinal direction of a hammer bit and vibration transmission from the main body to the handle is prevented. Further, interference of a lever of the brush holder unit and the handle is prevented by a part of an opening formed on the handle.

12 Claims, 21 Drawing Sheets

POWER TOOL

CROSS REFERENCE TO RELATED APPLICATION

The present application claims priority from Japanese Patent Applications No. 2013-244448 filed on Nov. 26, 2013, the entire contents of which are incorporated by reference herein.

FIELD OF THE INVENTION

The present invention relates to a power tool which drives a tool bit and performs a predetermined operation.

BACKGROUND OF THE INVENTION

WO 2007/068535 discloses a rotary hammer having a drive unit and a transmission unit. A driving torque of the drive unit is transmitted to the transmission unit and thereby an operation is performed. The rotary hammer further comprises a housing unit which houses the drive unit and another housing unit which houses the transmission unit. The housing unit for the drive unit has a main handle integrally jointed to it. Further, the housing unit for the drive unit and the housing unit for the transmission unit are moved relatively to each other and thereby transmission of vibration between the both housing unit is prevented.

SUMMARY OF THE INVENTION

Problem to be Solved by the Invention

In the rotary hammer described above, since the drive unit and the transmission unit are moved relatively to each other, a specially formed bellow-like transmitting member is utilized to allow the relative movement and to transmit the drive torque from the drive unit to the transmission unit. However, to provide the specially formed member which is not widely or generally used member in the rotary hammer may make price of the rotary hammer expensive, further loss of the transmission of the drive torque may be increased.

Accordingly, an object of the present invention is, in consideration of the above described problem, to provide an improved technique for transmission of torque of the motor and a vibration proof of a main handle in a power tool.

Means for Solving the Problem

Above-mentioned problem is solved by the present invention. According to a preferable aspect of the invention, a power tool which drives a tool bit in a longitudinal direction of the tool bit and performs an operation is provided. The power tool comprises a driving mechanism, a motor, a switching member, a main body and a main handle. The driving mechanism is configured to drive the tool bit. The motor has a brush and is configured to drive the driving mechanism. A position of the brush is selectively switched in a first rotational position in which a rotational shaft of the motor rotates in a predetermined first direction and a second rotational position in which the rotational shaft of the motor rotates in a second direction opposite to the first direction. The switching member is manually operated by a user for switching the position of the brush. Further, the switching is movable between a first position which positions the brush in the first rotational position and a second position which positions the brush in the second rotational position. The main body is configured to hold the driving mechanism, the motor and the switching member. The main handle is biased by a biasing member in the longitudinal direction of the tool bit, which is arranged between the main body and the main handle. Further, the main handle is relatively movable with respect to the main body in a state that the biasing member biases the main handle, and the vibration caused on the main body during the operation is prevented from being transmitted to the main handle. Further, the main handle includes an interference avoidance part which avoids interference between the switching member and the main handle when the switching member is positioned in the first position or the second position and the main handle is moved with respect to the main body. The interference avoidance part is, typically, provided by a recess or a through hole formed on the main handle.

Generally, a position of the brush with respect to a commutator around a rotational axis of the motor is adjusted and thereby a driving of the motor is optimized. A position of the brush for a forward rotation of the motor and a position of the brush for a reverse rotation of the motor are difference to each other. Therefore, in the present invention, the brush is switched and located at respective positions based on rotation directions of the motor. That is, when the motor is rotated in the forward rotational direction, the brush is configured to be located in a forward rotational position, while when the motor is rotated in the reverse rotational direction, the brush is configured to be located in a reverse rotational position. The forward rotational position corresponds to a first rotational position of the present invention, and the reverse rotational position corresponds to a second rotational position of the invention.

According to this aspect, as the motor is housed in the main body which holds the tool bit, a specially formed member for transmitting rotation of the motor to the tool bit is not necessary. Further, the main handle is movable with respect to the main body in a state that the main handle is biased by the biasing member. Thus, transmission of vibration from the main body to the main handle is prevented. Accordingly, transmission of rotation of the motor to the tool bit and vibration reduction of the main handle are rationally achieved. Further, the switching member held by the main handle is operated by a user, therefore, the switching member is exposed to the outside of the power tool. On the other hand, the main handle and the main body are relatively movable with each other for vibration reduction of the main handle. Thus, the power tool has the interference avoidance part which avoids interference between the switching member and the main handle. Accordingly, the interference avoidance part allows the relative movement of the main handle with respect to the main body.

According to a further preferable aspect of the invention, the first position and the second position are defined as each position in a crossing direction crossing the longitudinal direction of the tool bit. Therefore, the switching member is configured to move in the crossing direction. Further, the main handle is configured to move in the longitudinal direction of the tool bit with respect to the main body. Further, the main handle has an engagement part which is engageable with the switching member positioned in an intermediate position between the first position and the second position. Further, the main handle is prevented from moving in the longitudinal direction of the tool bit with respect to the main body by an engagement of the switching member and the engagement part.

According to this aspect, when the motor is driven the main handle is moved with respect to the main body during the operation, interference of the switching member and the main handle is prevented. On the other hand, when the motor is not driven, namely the switching member is positioned in the intermediate position, the main handle is engaged with the switching member. Thus, relative movement of the main handle with respect to the main body is prevented when the power tool is not driven.

According to a further preferable aspect of the invention, the power tool comprises a moving preventing part which prevents the switching member from moving to an intermediate position between the first position and the second position when the switching member is positioned in the first position or the second position and the motor is turned on. The moving preventing part may be configured to directly engage with the switching member and prevent the switching member from moving, or the moving preventing part may be configured to indirectly engage with the switching member via an intervening member and prevent the switching member from moving.

According to this aspect, the moving preventing part prevents the switching member from moving when the motor is driving. Accordingly, the brush is held in the optimized position based on the rotational direction of the motor when the motor is driving.

According to a further preferable aspect of the invention, the power tool comprises a trigger which is manually operated by a user for driving the motor. Further, the main handle is configured to move between a proximal position which is proximal to the tool bit and a separated position which is separated from the proximal position in the longitudinal direction of the tool bit. Further, the main handle is biased by the biasing member toward the separated position in the longitudinal direction of the tool bit. Further, the moving preventing part is provided with a first preventing portion which is arranged on the trigger and a second preventing portion which is arranged on the main handle. Further, in a state that the motor is driven by manipulation of the trigger, (i) when the main handle is positioned in the proximal position, the second preventing portion engages with the switching member and prevents the switching member from moving to the intermediate position, and (ii) when the main handle is positioned in the separated position, the first preventing portion engages with the switching member and prevents the switching member from moving to the intermediate position.

According to this aspect, the main handle is slid against the main body between the proximal position and the separated position during the operation. On the other hand, the switching member is prevented from moving to the intermediate position by the first preventing portion arranged on the trigger or the second preventing portion arranged on the main handle. In other words, the switching member is prevented from moving by not only the main handle but also the trigger. Accordingly, the switching member is prevented from moving to the intermediate position without relation to a position of the main handle when the motor is driving. As a result, the switching member is rationally prevented from moving when the motor is driving, and thereby the brush is stably held in the predetermined position.

According to a further preferable aspect of the invention, the power tool comprises a trigger which is manually operated by a user for driving the motor, and an intervening member which is arranged between the trigger and the switching member. The intervening member is engageable with the trigger and the switching member respectively. Further, the moving preventing part is provided by the intervening member. That is, the intervening member is engageable with both of the trigger and the switching member, respectively. Accordingly, the intervening member engages with the trigger and the switching member and prevents the switching member from moving to the intermediate position without relation to a position of the main handle against the main body in the longitudinal direction of the tool bit. Further, the second preventing portion may be provided on the main handle which is engageable with the switching member. In such a construction, the intervening member engages with the trigger and the switching member and prevents the switching member from moving to the intermediate position, and further the second preventing portion engages with the switching member and preventing the switching member from moving to the intermediate position.

According to a further preferable aspect of the invention, the power tool comprises a trigger switch which is fixed on the main handle and operated by the trigger. Further, the intervening member is supported by the main handle and/or the trigger switch. Further, the intervening member is configured to move integrally with the switching member in a direction crossing the longitudinal direction of the tool bit by engaging with the switching member moving between the first position and the second position. Further, the intervening member is configured to move with respect to the switching member in the longitudinal direction of the tool bit together with a relative movement between the main body and the main handle.

According to this aspect, the intervening member is supported by the main handle and/or the trigger switch. When the main handle is slid against the main body, the relative position of the trigger and the switching member is changed. On the other hand, the intervening member is supported by the main handle and/or the trigger switch fixed on the main handle such that the intervening member is relatively movable against the switching member, therefore the relative position between the trigger and the intervening member is maintained. Accordingly, the intervening member stably engages with the trigger without relation to a position of the main handle against the main body in the longitudinal direction of the tool bit during an operation. Thus, the switching member is prevented from moving to the intermediate position by the trigger when the motor is driving.

According to a further preferable aspect of the invention, the switching member comprises a brush holding part which holds the brush, the brush holding part being movable around a rotational axis of the motor, and an operated part which is connected to the brush holder, the operated part being manually operated by a user. Further, the operated part is provided such that the operated member protrudes from the brush holding part in a direction perpendicular to the rotational axis of the motor. Further, the interference avoidance part is provided with a through hole which is formed on the main handle. Further, the operated part is exposed to the outside of the power tool by extending through the through hole. Further, the through hole as the interference avoidance part is provided with a first interference avoidance part which extends in the longitudinal direction of the tool bit for avoiding interference between the switching member located in the first position and the main handle and a second interference avoidance part which extends in the longitudinal direction of the tool bit for avoiding interference between the switching member located in the second position and the main handle. Further, the first interference avoidance part and the second interference avoidance part are connected to each other.

According to another preferable aspect of the invention, a power tool which drives a tool bit in a longitudinal direction of the tool bit and performs an operation is provided. The power tool comprises a driving mechanism, a motor, a switching member, a main body and a main handle. The driving mechanism is configured to drive the tool bit. The motor has a brush and is configured to drive the driving mechanism. A position of the brush is selectively switched in a first rotational position in which a rotational shaft of the motor rotates in a predetermined first direction and a second rotational position in which the rotational shaft of the motor rotates in a second direction opposite to the first direction. The switching member is manually operated by a user for switching the position of the brush. Further, the switching is movable between a first position which positions the brush in the first rotational position and a second position which positions the brush in the second rotational position. The main body is configured to hold the driving mechanism, the motor and the switching member. The main handle is biased by a biasing member in the longitudinal direction of the tool bit, which is arranged between the main body and the main handle. Further, the main handle is relatively movable with respect to the main body in a state that the biasing member biases the main handle, and the vibration caused on the main body during the operation is prevented from being transmitted to the main handle. Further, the main handle includes a recess to which the switching member protrudes. Further, the recess extends in the longitudinal direction of the tool bit. Typically, the switching member is configured to move within the recess in the longitudinal direction and interference between the switching member and the main handle is avoided by the recess. Preferably, the switching member includes a projection which protrudes the recess of the main handle, and the projection moves in the longitudinal direction of the tool bit when the main handle is moved in the longitudinal direction with respect to the main body. Further, the recess has a length in the longitudinal direction such that the projection of the switching member is prevented from contacting with an edge of the recess in the longitudinal direction. Typically, the recess may be provided by a through-hole which is formed on the main handle.

Accordingly, an improved technique for transmission of torque of the motor and a vibration proof of a main handle in a power tool is provided.

Other objects, features and advantages of the invention will be readily understood after reading the following detailed description together with the accompanying drawings and the claims.

DESCRIPTION OF THE PREFERRED EMBODIMENTS

Each of the additional features and method steps disclosed above and below may be utilized separately or in conjunction with other features and method steps to provide and manufacture improved power tools and method for using such power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

(First Embodiment)

Figure 1:
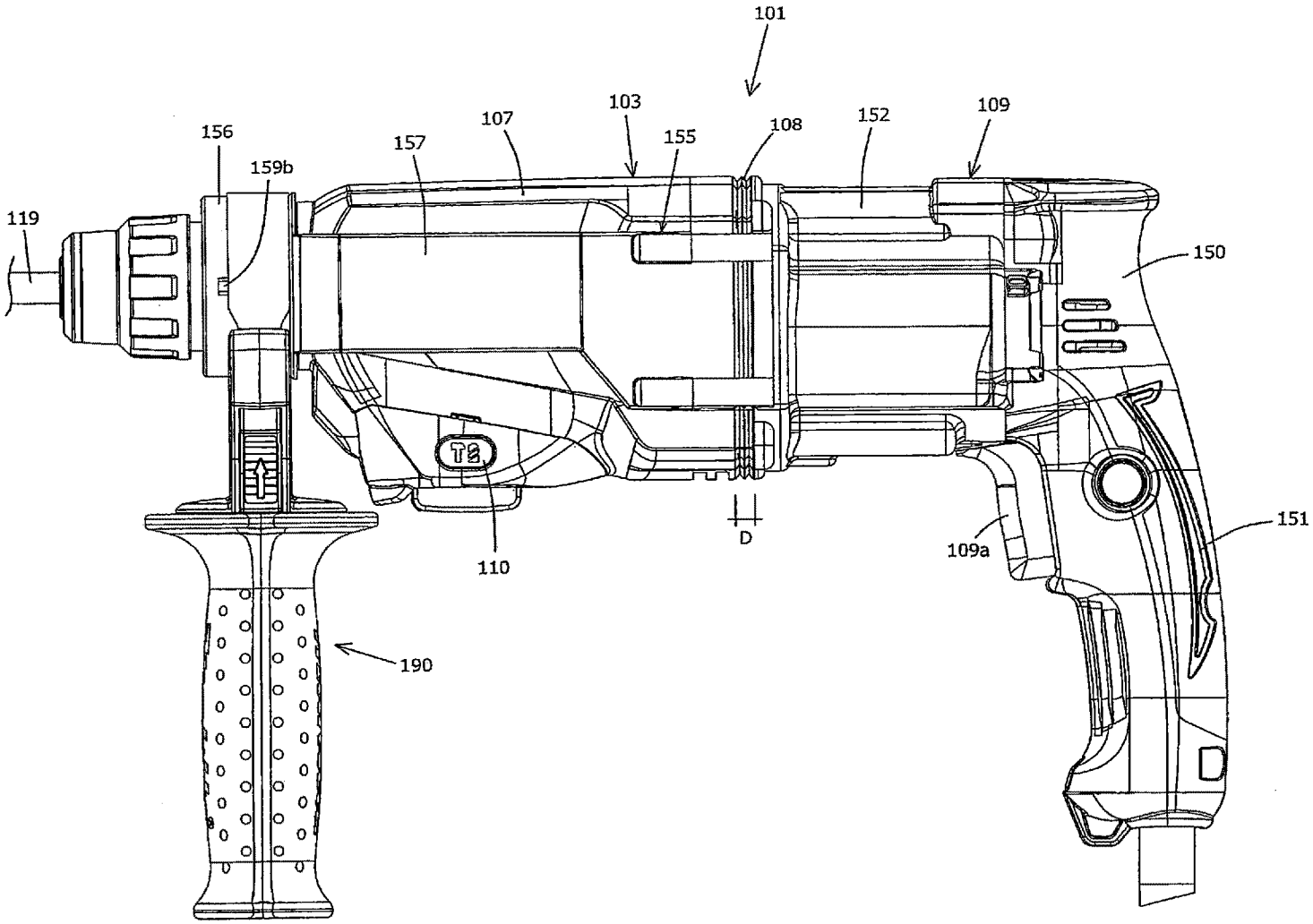
FIG. 1 shows a cross sectional view of a hammer drill according to a first embodiment of the present invention.
Figure 2:
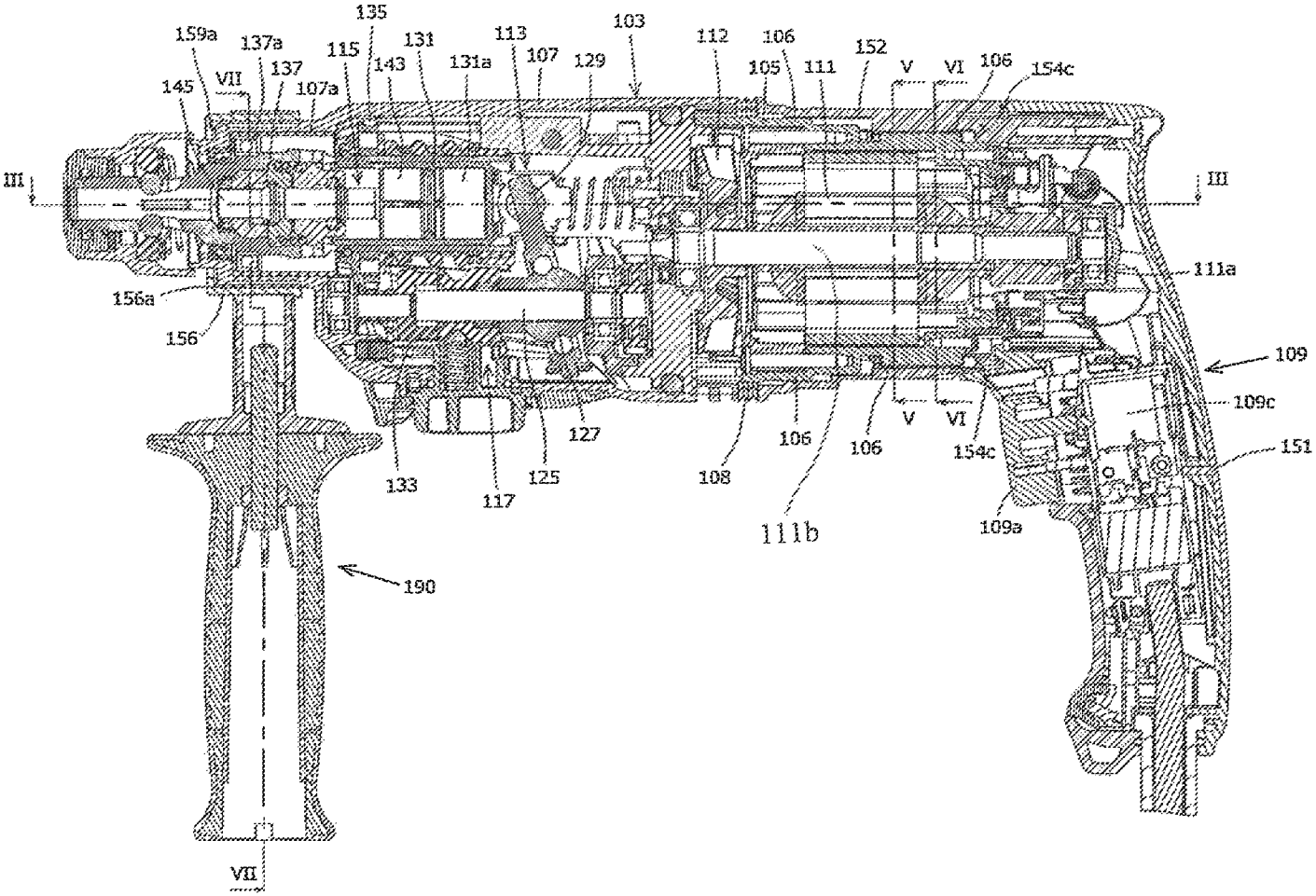
FIG. 2 shows a side cross sectional view of the hammer drill.
Figure 3:
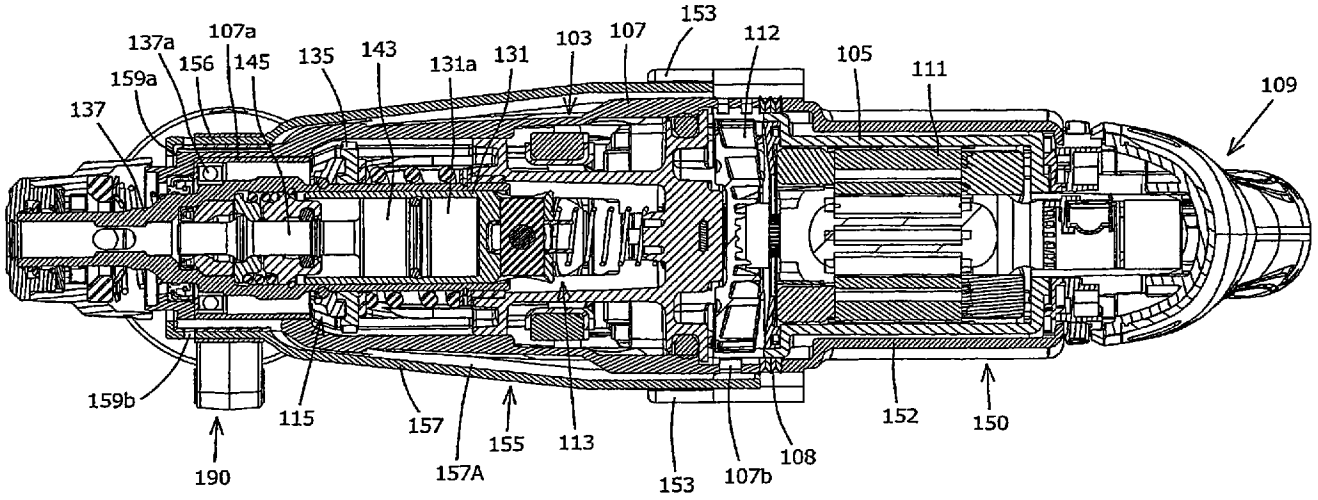
FIG. 3 shows a cross sectional view taken along the line in FIG. 2.

An exemplary embodiment of the present invention is explained with reference to FIG. 1 to FIG. 17. An electrical hammer drill which corresponds to one example of a power tool is utilized to explain the present invention hereafter. As shown in FIG. 1, the hammer drill 100 is mainly provided with a main body 103, a handle 109 and a hammer bit 119. As shown in FIG. 2 and FIG. 3, a tool holder 137 is arranged at a front region (left side in FIG. 2) of the main body 103 and the hammer bit 119 is detachably attached to the tool holder 137. A grip portion 151 of the handle 109 is arranged at a rear region of the main body 103 which is opposite to the front region in an axial direction of the hammer bit 119.

(Driving Mechanism)

Figure 4:
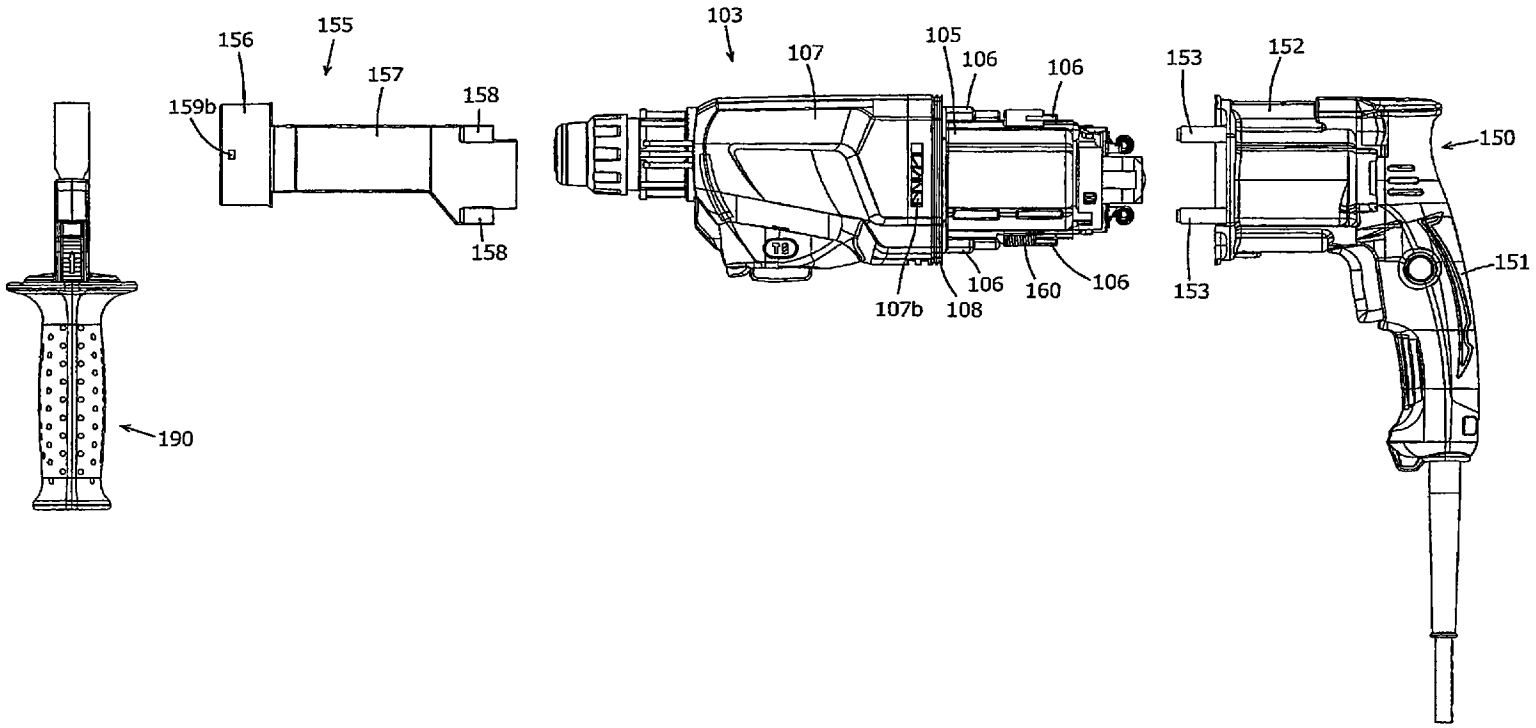
FIG. 4 shows an exploded side view of the hammer drill.

As shown in FIG. 2 to FIG. 4, the main body 103 is mainly provided with a motor housing 105 which houses a driving motor 111 and a gear housing 107 which houses a motion converting mechanism 113, a hammering element 115 and a rotation transmission mechanism 117. The gear housing 107 comprises a bearing holding portion 107*a* at its front region, which holds a bearing 137*a* for supporting the tool holder 137. Further, the gear housing 107 comprises an opening 107*b* which communicates inside the gear housing 107 with the outside the gear housing 107. The driving motor 111 is one example which corresponds to "a motor" according to the present invention. Each of the motion converting mechanism 113, the hammering element 115 and the rotation transmission mechanism 117 is one example which corresponds to "a driving mechanism" according to the present invention. Further, the main body 103 is one example which corresponds to "a main body" according to the present invention.

The driving motor 111 is arranged such that its rotation axis extends parallel to a longitudinal direction of the hammer bit 119. A cooling fan 112 is mounted on a rotational shaft 111*b* of the driving motor 111 at a front region of the driving motor 111. That is, the cooling fan 112 is arranged between the driving mechanism and the driving motor 111 with respect to the longitudinal direction of the hammer bit 119. When the driving motor 111 turns, the cooling fan 112 is driven and thereby a cooling air is generated. The cooling fan 112 is formed as a centrifugal fan. The cooling air which is flowed through inside the gear housing 107 is discharged from the opening 107*b* which is formed on a side surface of the gear housing 107. That is, the opening 107*b* is provided so as to correspond to the cooling fan 112. A rotational output (torque) of the driving motor 111 is converted to a linear motion in the longitudinal direction of the hammer bit 119 by the motion converting mechanism 113 which is arranged in front of the driving motor 111. Further, the linear motion is transmitted to the hammering element 115 and thereby impact force (hammering force) in the longitudinal direction (lateral direction of the FIG. 1) of the hammer bit 119 is generated by the hammering element 115. Further, the rotational output (torque) is transmitted to the rotation transmission mechanism 117 which is arranged in front of the driving motor 111, and then rotation speed of the rotational output is reduced and transmitted to the hammer bit 119. Thus, the hammer bit 119 is rotationally driven. The driving motor 111 is driven (turned on) when a trigger 109*a* arranged on the handle 109 is manipulated (pulled). For convenience, the hammer bit 119 side of the hammer drill 101 is defined as a front side, and the handle 109 side of the hammer drill 101 is defined as a rear side.

The motion converting mechanism 113 is mainly provided with an intermediate shaft 125, a swing member 129 and a cylindrical piston 131. The intermediate shaft 125 is arranged parallel to the rotational shaft 111*b* of the driving motor 111 and driven by the driving motor 111. When the intermediate shaft 125 is rotationally driven, the swing member 129 is swung in the longitudinal direction of the hammer bit 119 via a rotation body 127 mounted on the intermediate shaft 125. When the swing member 129 is swung, the cylindrical piston 131 is linearly driven (reciprocated) in the longitudinal direction.

The rotation transmission mechanism 117 is mainly provided with a speed reducing gear mechanism which comprises a plurality of gears. The speed reducing gear mechanism is provided with a small diameter gear 133 which is driven integrally with the intermediate shaft 125 and a large diameter gear 135 which meshes with the small diameter gear 133. The rotation transmission mechanism 117 transmits rotation of the driving motor 111 to the tool holder 137. The tool holder 137 is rotatably supported by the bearing 137*a* which is held on the bearing holding portion 107*a*. Accordingly, the tool holder 137 is rotationally driven and thereby the hammer bit 119 held by the tool holder 137 is rotationally driven. The bearing holding portion 107*a* is formed as a metallic cylindrical member made by aluminum like that.

The hammering element 115 is mainly provided with a striker 143 and an impact bolt 145. The striker 143 is provided as a hammering element which is slidably arranged within the cylindrical piston 131. The impact bolt 145 is provided as an intermediate element which is slidably arranged within the tool holder 137. The striker 143 is driven (slid) by an air spring (air fluctuation) of an air chamber 131*a* caused by the driving of the cylindrical piston 131 and strikes the impact bolt 145. Accordingly, the hammering force on the hammer bit 119 is caused by the impact bolt 145.

(Brush Holder Unit)

Figure 12:
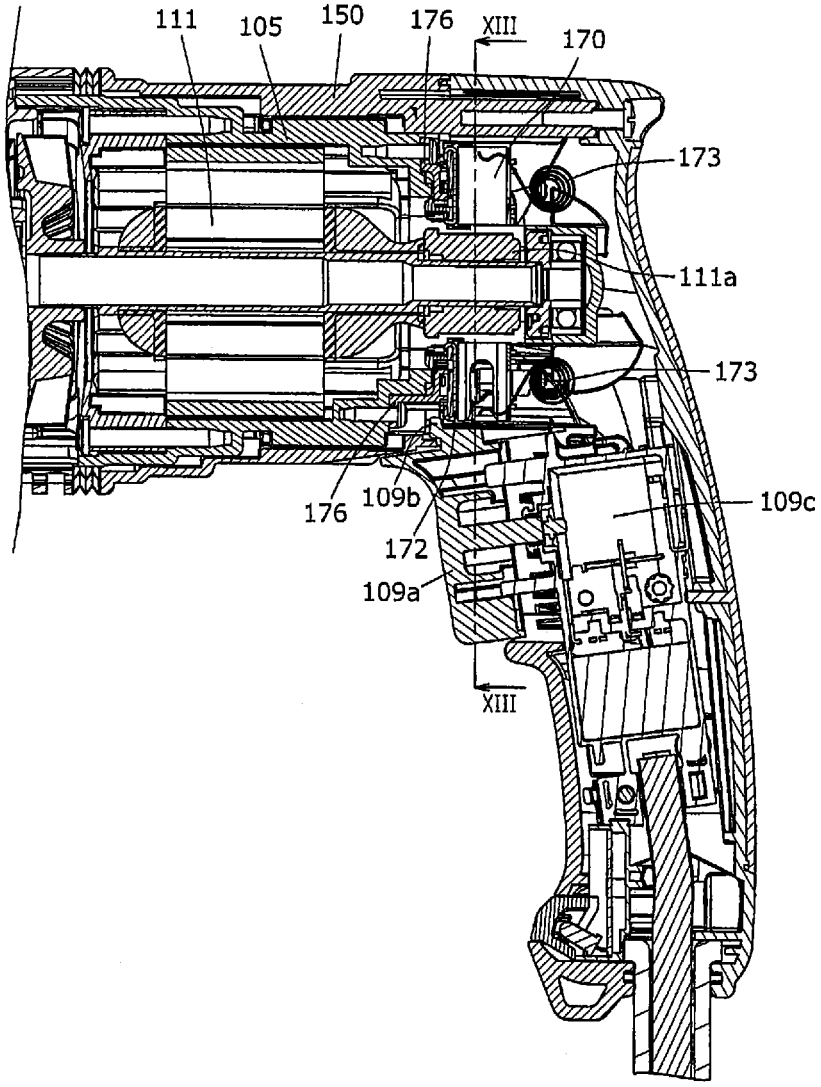
FIG. 12 shows a cross sectional view of FIG. 11.
Figure 13:
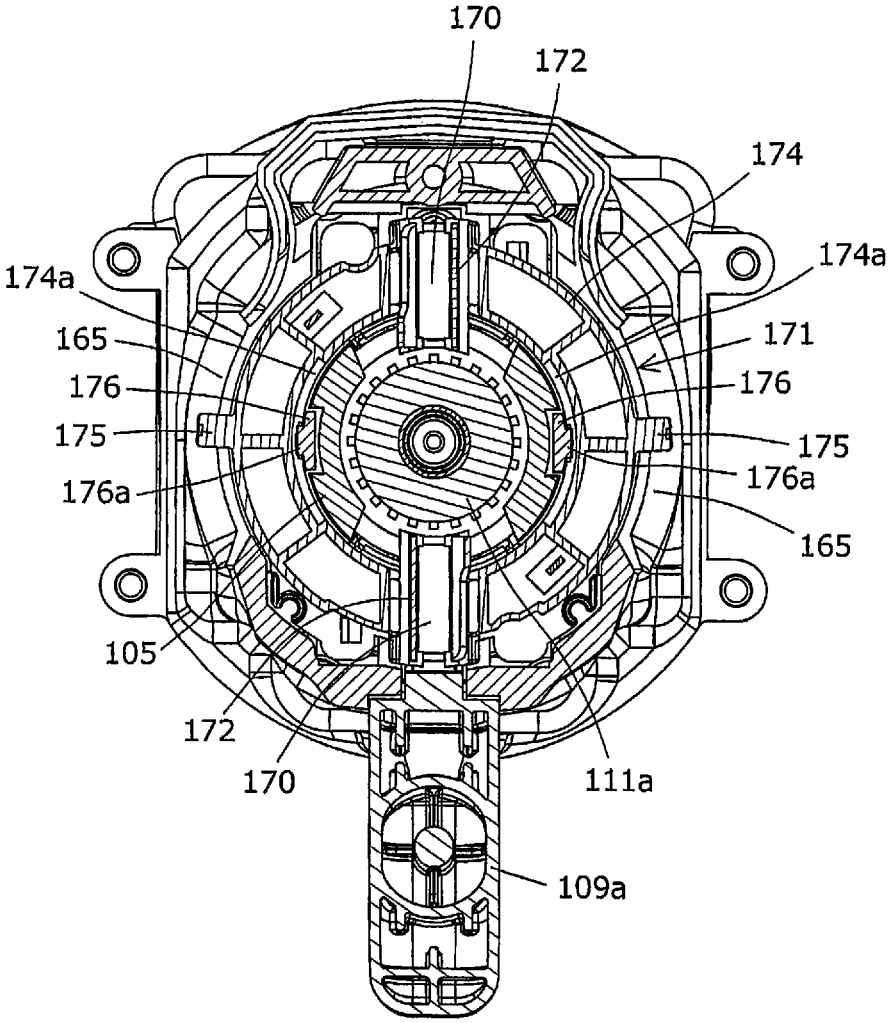
FIG. 13 shows a cross sectional view taken along the XIII-XIII line in FIG. 12.
Figure 14:
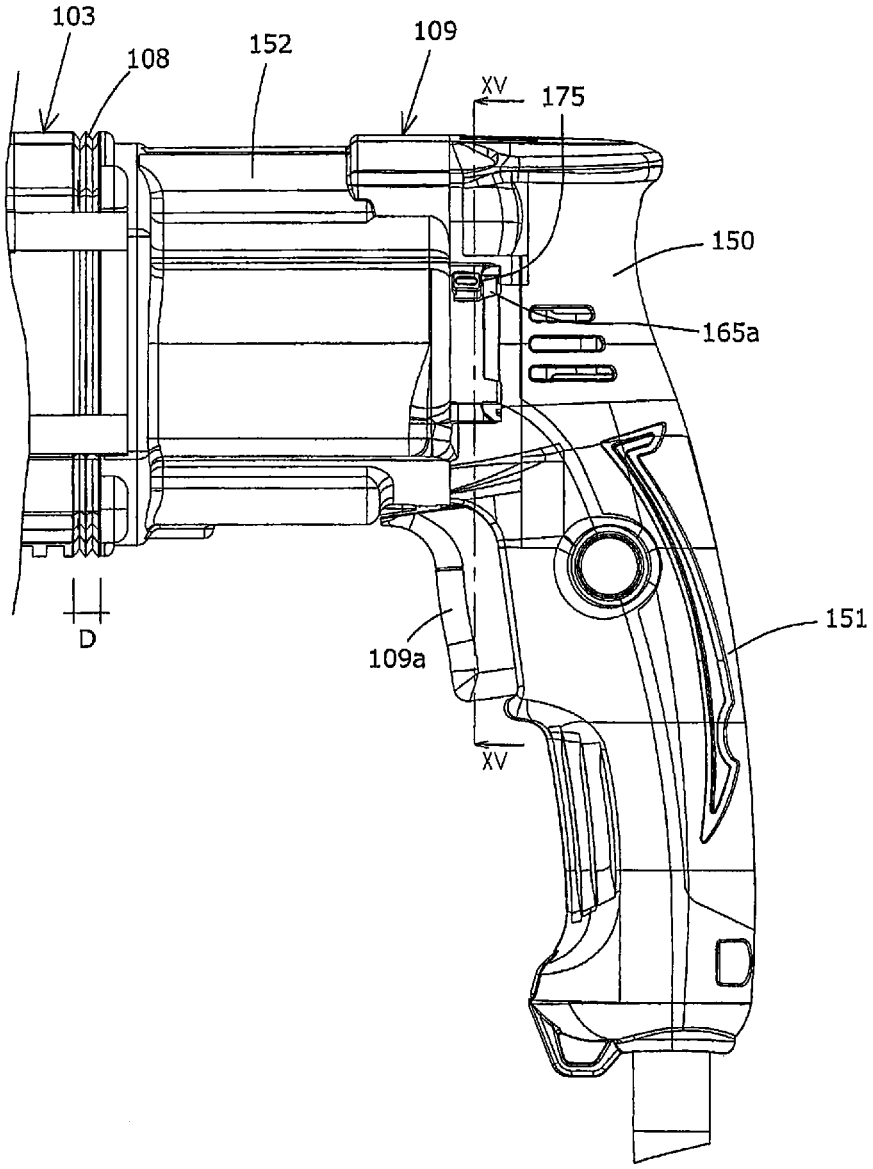
FIG. 14 shows an enlarged side view of the handle in which a lever is located corresponding to a forward driving of a motor.

As shown in FIG. 12 and FIG. 13, the driving motor 111 is provided as a brush motor which includes a brush 170 for providing electric current to a commutator 111*a*. The brush 170 is held by a brush holder unit 171. In the brush motor, an optimum advanced angle of the motor is determined. Therefore, by controlling the advanced angle of the motor, the brush motor is driven in an optimized rotation. As to the advanced angle of the motor, an optimum advanced angle of the motor when the motor is driven in a predetermined forward rotation direction and an optimum advanced angle of the motor when the motor is driven in an opposite reverse rotation direction opposite to the forward rotation direction are different to each other. That is, if the advanced angle of the motor for the forward rotation direction is selected and the motor is driven in the reverse rotation direction, it causes a bad effect to a driving of the motor. Therefore, in order not to cause performance differences of the motor driven in the forward rotation direction and in the reverse rotation direction, a position of the brush 170 is set in each optimum advanced angle. In the hammer drill 101, the brush holder unit 171 holds the brush 170 and switches the position of the brush 170.

As shown in FIG. 12 and FIG. 13, the brush holder unit 171 is mainly provided with a brush holder 172, a spring 173, a rotatable body 174, a lever 175 and a supporting body 176. The brush holder 172 holds the brush 170 to be slidable in a radial direction of the brush holder unit 171 (a radial direction of the commutator 111*a*). The brush 170 is provided with a positive side brush and a negative side brush, and the respective brushes are supported to be opposite to each other by two brush holders 172 respectively. The spring 173 biases the brush 170 held by the brush holder 172 toward the commutator 111*a* in the radial direction. The rotatable body 174 is a disk shaped member and the rotatable body 174 is supported by the supporting body 176 which is fixed on the motor housing 105. The rotatable body 174 is configured to rotate integrally with the brush holder 172. As shown in FIG. 12, the supporting body 176 is fixed on the motor housing 105 by screws. As shown in FIG. 13, a recess 174*a* is formed on the inner surface (commutator side surface) of the rotatable body 174. Further, a projection 176*a* is formed on the supporting body 176 to be faced the recess 174*a*. Accordingly, the recess 174*a* and the projection 176*a* are engageable with each other. The lever 175 is provided on the rotatable body 174 such that it protrudes from the outer surface of the rotatable body 174 in the radial direction of the rotatable body 174. The lever 175 penetrates an opening 165 formed on the handle rear side part 150 of the handle 109 and thereby the lever 175 is exposed to the outside of the hammer drill 101. Accordingly, a user manipulates the lever 175 from outside the handle 109 and the rotatable body 174 is rotated around a rotational axis of the driving motor 111, and thereby the position of the brush 170 with respect to the commutator 111*a* is switched (changed). That is, the positive side brush and the negative side brush are rotated integrally and respective positions are switched. When the rotatably body 174 is rotated, the recess 174*a* and the projection 176*a* are engaged with each other and thereby further rotation of the rotatable body 174 is prevented. In other words, the movable range of the rotatable body 174 around the commutator 111*a* is defined by the recess 174*a* and the projection 176*a*.

Figure 11:
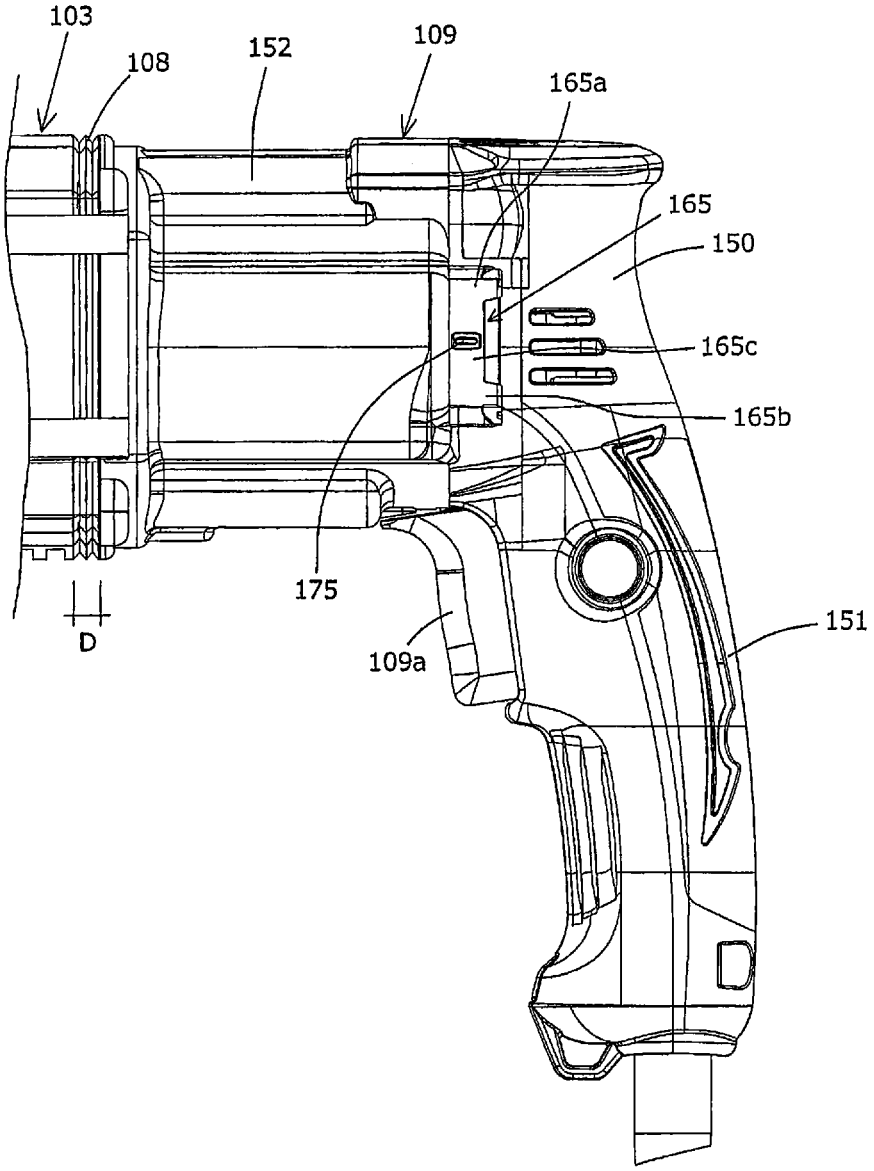
FIG. 11 shows an enlarged side view of a handle.

Specifically, the position of the brush 170 illustrated in FIG. 11 to FIG. 13 is defined as a neutral position of the brush 170 (lever 175). When the lever 175 is manipulated and positioned in the position illustrated in FIG. 14 and FIG. 15, the brush 170 is positioned in a forward rotational position, while, when the lever 175 is manipulated and positioned in the position illustrated in FIG. 16 and FIG. 17, the brush 170 is positioned in a reverse rotational position. Accordingly, the brush 170 is positioned at each optimum position corresponding to the rotation direction (forward or reverse rotational direction) of the driving motor 111. The brush holder unit 171 having the lever 175 is one example which corresponds to "a switching member" according to the present invention. Further, the brush holder 172 and the rotatable body 174 is one example which corresponds to "a brush holding part" according to the present invention. Further, the lever 175 is one example which corresponds to "an operated part" according to the present invention. The forward and the reverse rotational positions of the brush 170 are examples which correspond to "a first rotational position" and "a second rotational position" according to the present invention, respectively.

In the hammer drill 101 described above, when the driving motor 111 is electrically driven, rotation of the driving motor 111 is converted into the linear motion by the motion converting mechanism 113 and then transmitted to the hammer bit 119 via the hammering element 115. Thus, the hammer bit 119 is linearly driven. Further, rotation of the driving motor 111 is transmitted to the hammer bit 119 via the rotation transmission mechanism 117. Thus, the hammer bit 119 is rotationally driven. As a result, the hammer bit 119 performs a hammer drill operation on a workpiece by the linear and rotational motion of the hammer bit 119.

As to driving modes of the hammer drill 101, as shown in FIG. 1, the hammer drill 101 comprises a mode select switch 110 for switching the driving modes. When a user manipulates the mode select switch 110, a hammer drill mode and a drill mode as the driving mode of the hammer drill 101 is switched. In the hammer drill mode, the hammer bit 119 is linearly and rotationally driven. In the drill mode, the hammer bit 119 is only rotationally driven.

(Main Handle)

As shown in FIG. 4, the handle 109 is served as a main handle made of resin, which is held by a user. The handle 109 is mainly provided with a handle rear side part 150 and a handle front side part 155. The handle rear side part 150 is mainly provided with a grip portion 151 which is held by a user and a cylindrical housing portion 152 which is arranged in front of the grip portion 151. The grip portion 151 is connected at a rear end of the housing portion 152 and extended downward from a connecting portion of the grip portion 151 and the housing portion 152. Namely, the grip portion 151 extends in a vertical direction crossing the longitudinal direction of the hammer bit 119. The distal end of the grip portion 151 is formed as a free end, and a cable for providing an electrical current to the hammer drill 101 is connected to the distal end of the grip portion 151. Further, the housing portion 152 includes an engagement projection 153 which protrudes frontward from the housing portion 152. In this embodiment, two projections 153 are provided.

Figure 7:
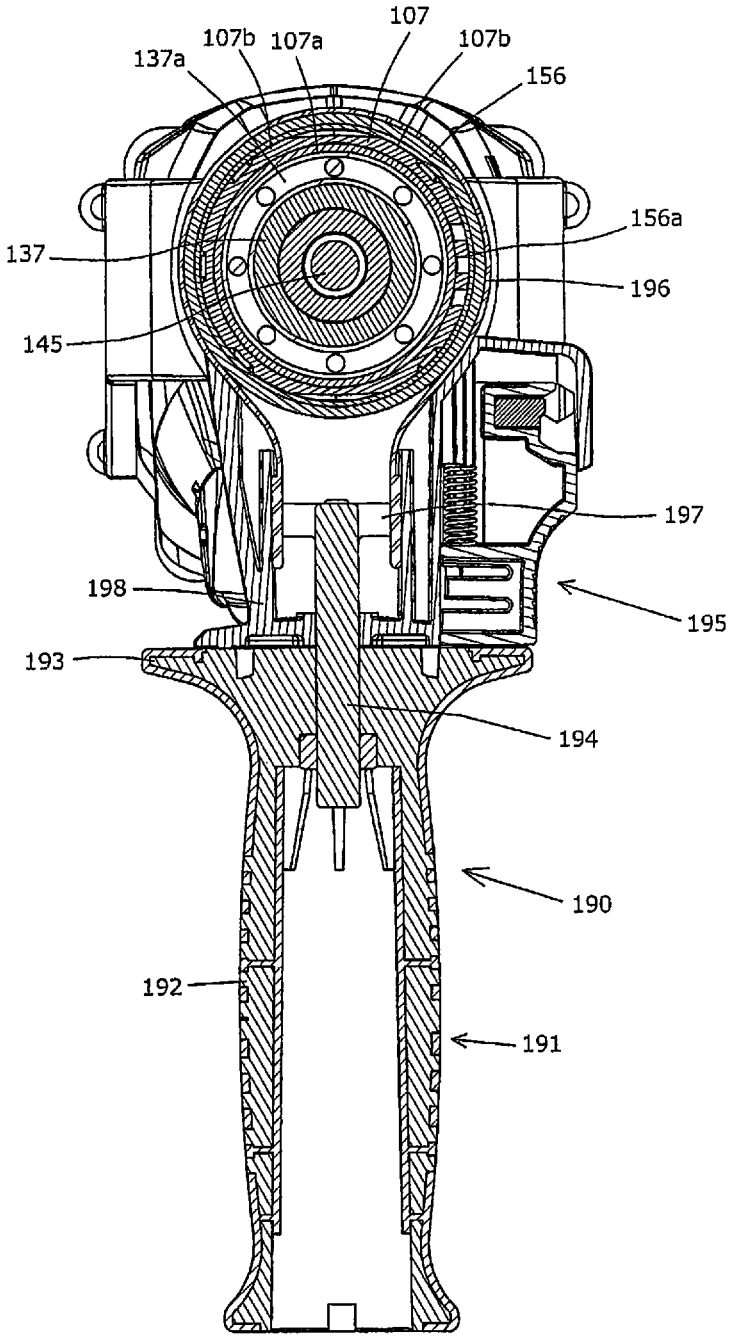
FIG. 7 shows a cross sectional view taken along the VII-VII line in FIG. 2.

The handle front side portion 155 is mainly provided with an auxiliary handle attachable portion 156 to which an auxiliary handle is attached and an extending portion 157 which is extended in the longitudinal direction of the hammer bit 119. The extending portion 157 is arranged at a rear of the auxiliary handle attachable portion 156. The auxiliary handle attachable portion 156 is formed as a ring-like member which surrounds the bearing holding portion 107*a* of the gear housing 107. Specifically, as shown in FIG. 7, the bearing holding portion 107*a* is arranged at the front region (hammer bit 119 side region) of the gear housing 107. Further, the bearing holding portion 107*a* has a plurality of projections 107*c* which are arranged at the periphery of the bearing holding portion 107*a* in predetermined interval in the circumference direction. Further, the auxiliary handle attachable portion 156 has a reinforcing ring 156*a* which engages with the top of the projections 107*c*. Further, as shown in FIG. 4, the extending portion 157 has an engagement recess 158 which is engagable with the engagement projection 153.

Further, as shown in FIG. 4, the motor housing 105 has a plurality of sliding guides 106. Each sliding guide 106 is disposed at respective outside position of the motor housing 105 (driving motor 111) in the circumference direction around the longitudinal direction of the hammer bit 119. Further, the sliding guides 106 are disposed at a front side region and a rear side region respectively with respect to the longitudinal direction of the hammer bit 119. Accordingly, the front side sliding guides 106 and the rear side sliding guides 106 are respectively disposed in a plurality positions on the motor housing 105 in the circumference direction of longitudinal direction of the hammer bit 119. The sliding guide 106 is provided with a metallic cover which covers a projection made of resin. The projection is formed on the surface of the motor housing 105. The metallic cover is made of metallic material such as steel, aluminum, magnesium, titanium and so on. Further, a plurality of coil springs 160 are disposed on an outer surface of the motor housing 105.

Figure 5:
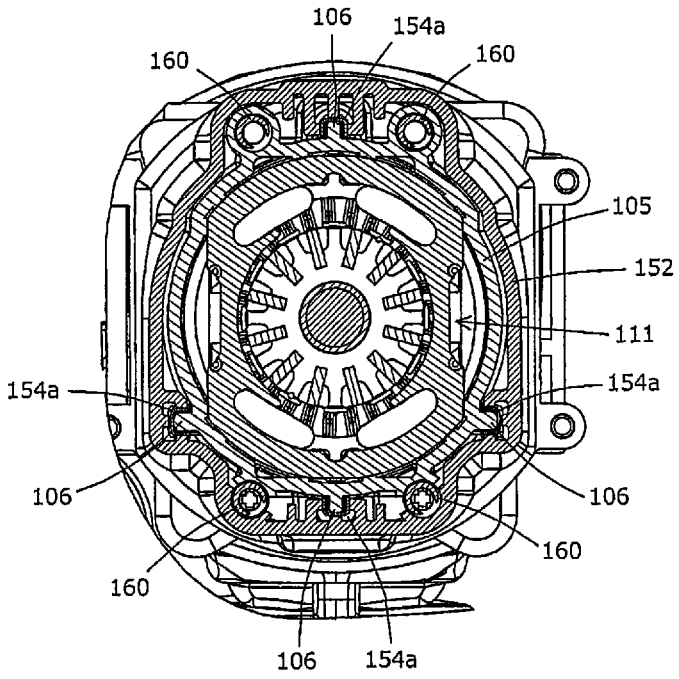
FIG. 5 shows a cross sectional view taken along the V-V line in FIG. 2.
Figure 6:
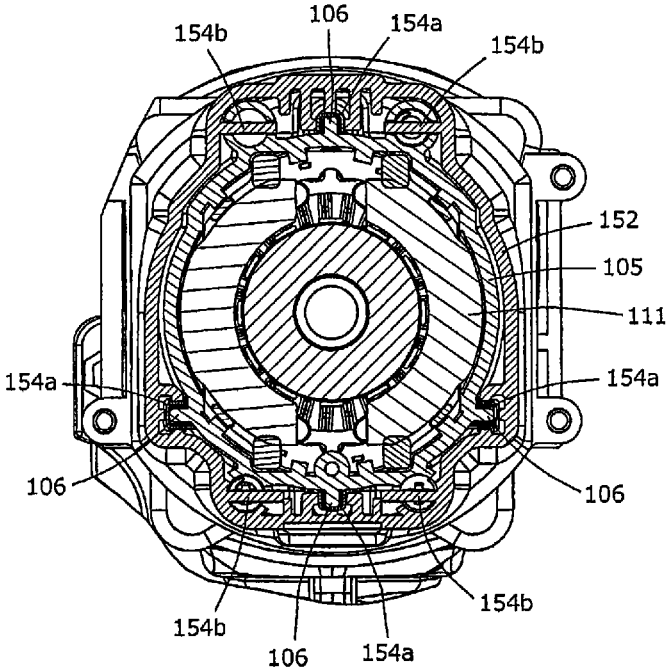
FIG. 6 shows a cross sectional view taken along the VI-VI line in FIG. 2.

As shown in FIG. 5 and FIG. 6, a plurality of recesses 154*a* which correspond to respective sliding guides 106 and a plurality of pressing portions 154*b* which correspond to respective coil springs 160 are disposed on an inner surface of the housing portion 152. The recess 154*a* is formed as a part of the housing portion 152 and therefore made of a resin such as polyamide (nylon). Further, as shown in FIG. 2, a contact portion 154*c* contactable with the sliding guide 106 is provided on the rear end of the recess 154*a*. Further, a contact portion 159*a* contactable with the front part of the gear housing 107 is provided at the front end of the auxiliary handle attachable portion 156. Further, as shown in FIG. 4, a through hole 159*b* is formed on the auxiliary handle attachable portion 156.

As shown in FIG. 1 to FIG. 3, the handle 109 described above is assembled outside the main body 103 such that the handle rear side part 150 is moved from the rear of the main body 103 and the handle front side part 155 from the front of the main body 103, and thereafter the handle rear side part 150 and the handle front side part 155 are connected by engagement of the engagement projection 153 and the engagement recess 158. Thus, the handle 109 is provided such that the housing portion 152 surrounds the motor housing 105 and the extending portion 157 extends along the gear housing 107. When assembled, the extending portion 157 forms a cooling air passage 157A from the opening 107*b* through the through hole 159*b* of the auxiliary handle attachable portion 156 between the extending portion 157 and the gear housing 107. The extending portion 157 has a U-shaped cross section orthogonal to an extending direction of the extending portion 157, and therefore the cooling air passage 157A is provided from the opening 107*b* formed on the side surface of the gear housing 107 to the front region of the gear housing 107 to which the hammer bit 119 is attached. Further, the housing portion 152 is arranged outside the motor housing 105 such that the recess 154*a* engages with the sliding guide 106 and the pressing portion 154*b* presses the coil spring 160. Thus, one end of the coil spring 160 contacts with the motor housing 105 and another end of the coil spring 160 contacts with the pressing portion 154*b* of the housing portion 152 and therefore the coil spring 160 biases the handle rear side part 150 from the motor housing 105. Thus, the handle rear side part 150 is pressed rearward by the coil spring 160 and at this time the contact portion 159*a* of the handle front side part 155 contacts with the front end part of the gear housing 107, and therefore the rear position of the handle 109 is defined. The coil spring 160 is one example which corresponds to "a biasing member" according to the present invention. Further, the handle 109 is one example which corresponds to "a main handle" according to the present invention.

A bellow-like member 108 is arranged between the gear housing 107 and the handle rear side portion 150. The bellow-like member 108 is an annular rubber member surrounding the gear housing 107 and extendable and contractable in the longitudinal direction of the hammer bit 119. Accordingly, a relative movement of the handle 109 against the gear housing 107 in the longitudinal direction of the hammer bit 119 is allowed. The bellow-like member 108 is also served as a sealing member which seals a gap between the main body 103 and the handle 109.

(Auxiliary Handle)

As shown in FIG. 7, the auxiliary handle 190 is configured to attach to the auxiliary handle attachable portion 156 of the handle 109. The auxiliary handle 190 is mainly provided with a holding portion 191 and an attaching portion 195. The holding portion 191 has a grip 192, a flange 193 and a bolt 194. The grip 192 is a substantially cylindrical resin member, which is held by a user. The flange 193 is provided at one end of the grip 192. The bolt 194 is provided such that it extends in a longitudinal direction of the grip 192 and protrudes from the flange 193. The attaching portion 195 has an engagement band 196, a nut 197 and a band holding portion 198. The engagement band 196 is a substantially annular band-like member and both ends of the band are connected to the nut 197. The band holding portion 198 is provided outside the engagement band 196 to support the engagement band 196. A through hole into which the bolt 196 penetrates is formed at a center region of the band holding portion 198.

In the auxiliary handle 190 described above, the bolt 194 is screwed to the nut 197 and unscrewed from the nut 197 by rotating the holding portion 191 around the longitudinal direction of the holding portion 191 against the band holding portion 198. Accordingly, a distance between the nut 197 and the flange 193 is changed. In a state that the engagement band 196 is arranged so as to surround the auxiliary handle attachable portion 156 of the handle 109, when the holding portion 191 is rotated in one direction around its axis, the engagement band 196 clamps the auxiliary handle attachable portion 156. At this time, the band holding portion 198 is interveningly arranged between the engagement band 196 and the flange 193 and thereby the auxiliary handle 190 is mounted to the auxiliary handle attachable portion 156. That is, the auxiliary handle 190 is attached so as to cover (surround) the auxiliary handle attachable portion 156. While, when the holding portion 191 is rotated in another direction around its axis, the engagement band 196 releases the auxiliary handle attachable portion 156. Accordingly, the auxiliary handle 190 is detached from the auxiliary handle attachable portion 156.

(Driving of Hammer Drill)

In the hammer drill 110 described above, when a user pulls the trigger 109*a*, the driving motor 111 is turned on. Accordingly, a hammer operation or a hammer drill operation is performed based on the driving mode selected by the mode select switch 110. During the operation by the hammer drill 101, vibration mainly in the longitudinal direction of the hammer bit 119 is occurred on the main body 103. At this time, as the handle 109 is movable with respect to the main body 103 in the longitudinal direction of the hammer bit 119, the handle 109 moves in the longitudinal direction of the hammer bit 119 based on vibration occurred during the operation.

Figure 8:
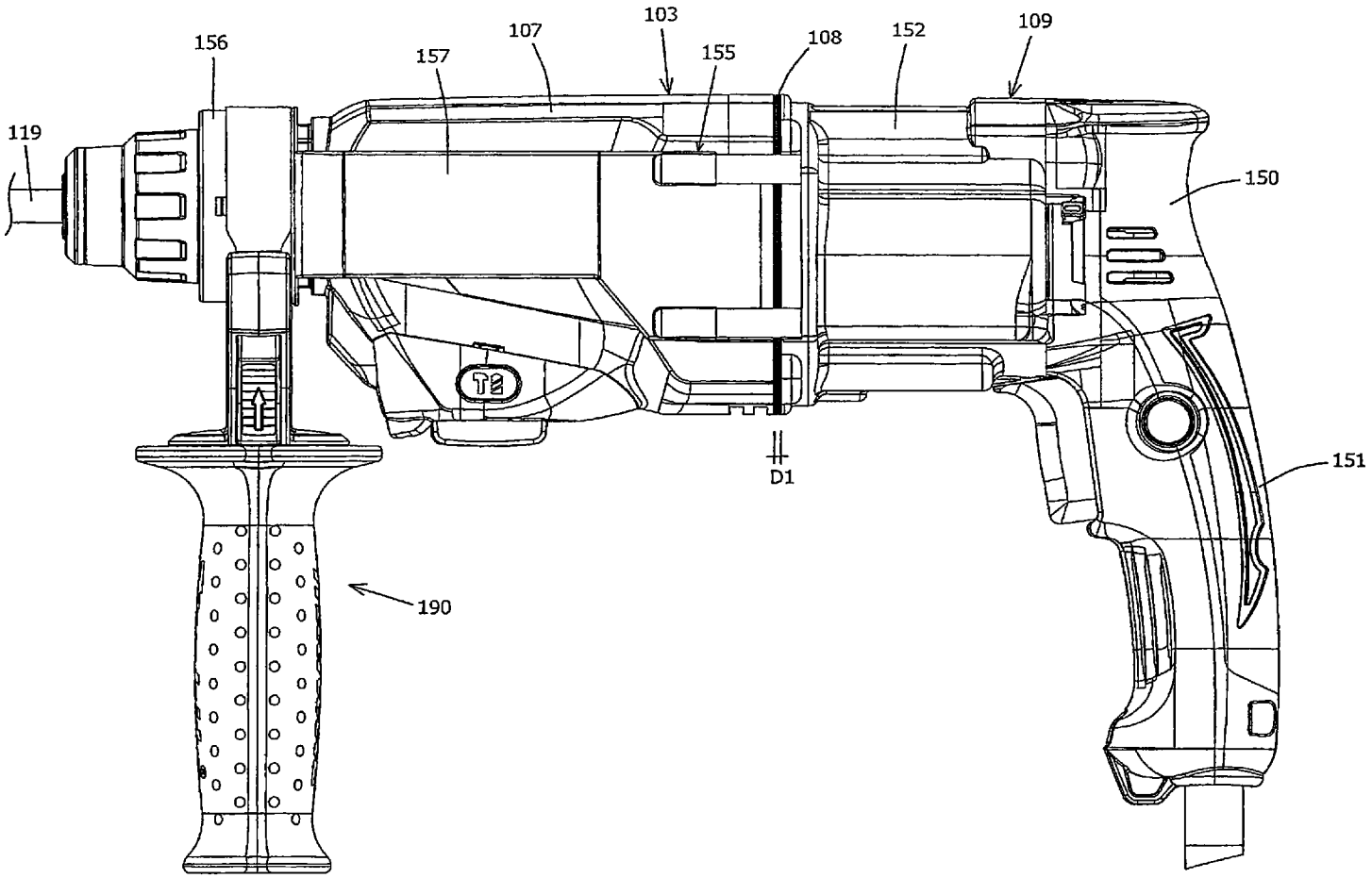
FIG. 8 shows a side view in which a main handle is positioned in a front position.
Figure 9:
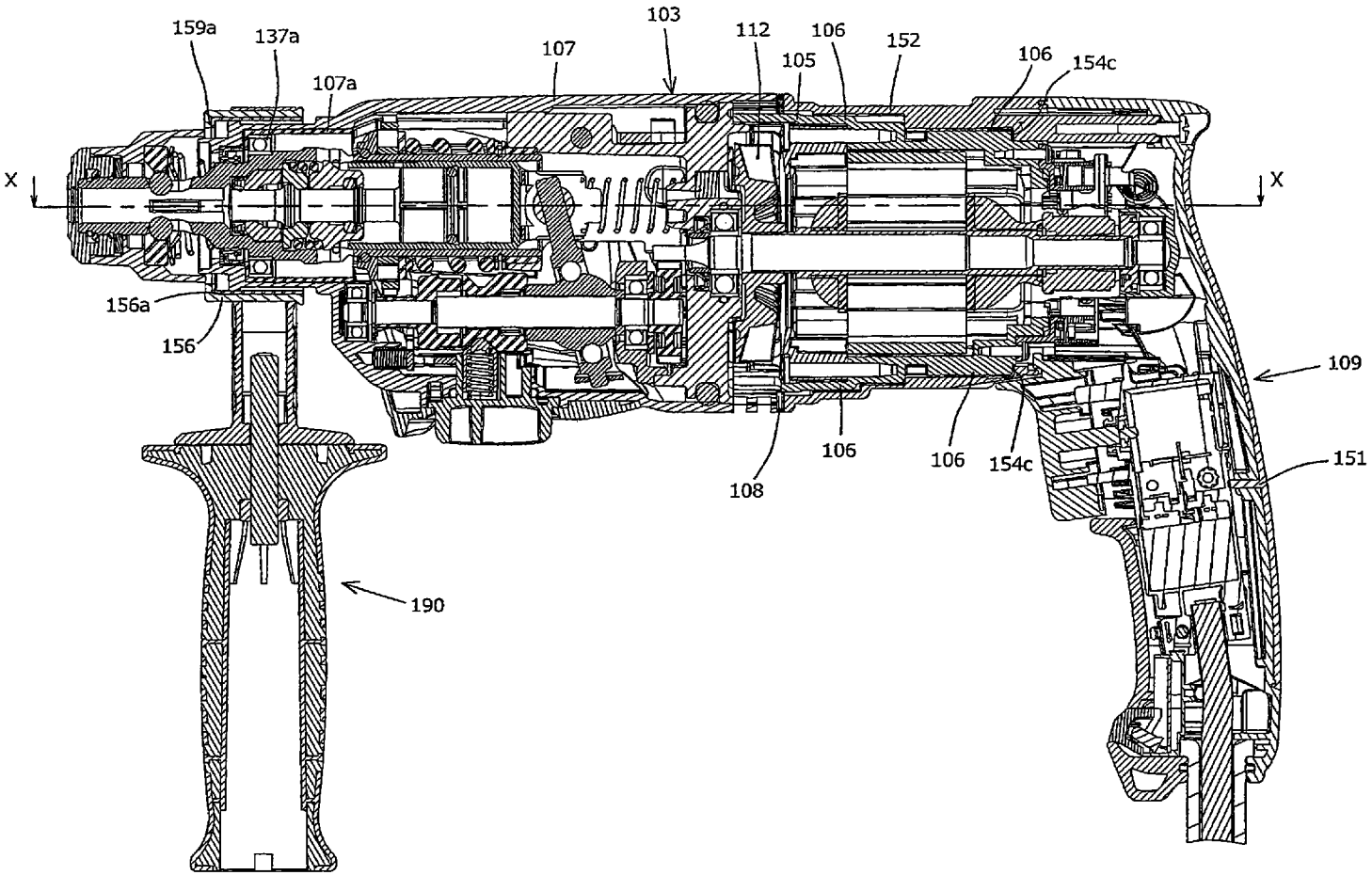
FIG. 9 shows a cross sectional view of FIG. 8.
Figure 10:
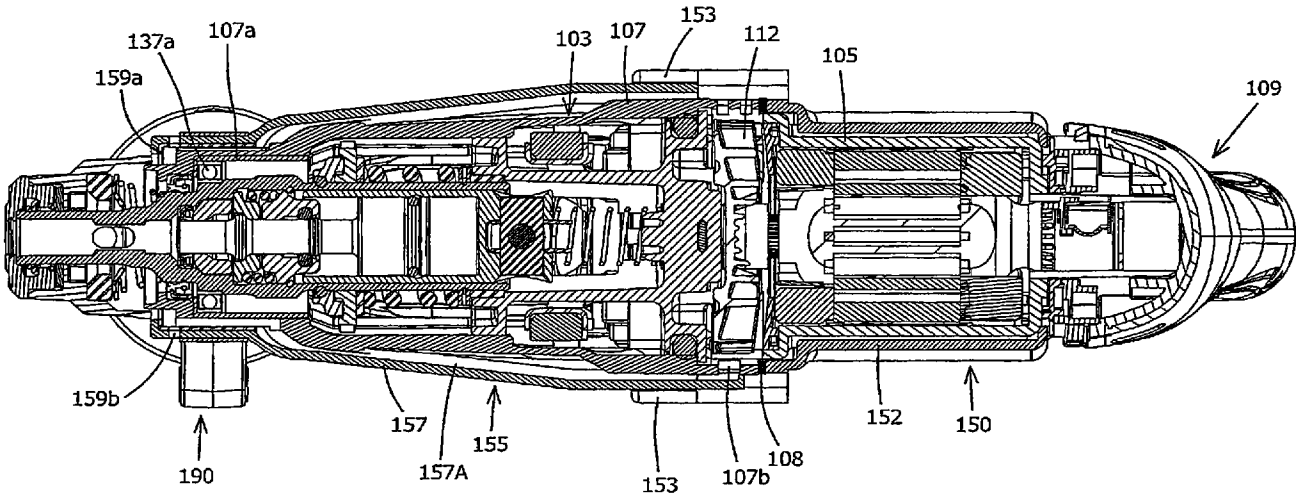
FIG. 10 shows a cross sectional view taken along the X-X line in FIG. 9.

Specifically, as shown in FIG. 1 to FIG. 3 and FIG. 8 to FIG. 10, the main body 103 and the handle 109 are relatively moved to each other in the longitudinal direction of the hammer bit 119. FIG. 1 to FIG. 3 illustrate the hammer drill 101 in which the handle 109 is positioned in relatively rear position against the main body 103. Further, FIG. 8 to FIG. 10 illustrate the hammer drill 101 in which the handle 109 is positioned in relatively front position against the main body 103.

As shown in FIG. 1 to FIG. 3, the handle 109 is positioned in a rear position by biasing force of the coil spring 160 (shown in FIG. 4 and FIG. 5). In the rear position, the housing portion 152 is disposed in distance D from the main body 103. The rear position is defined by contact between the contact portion 159*a* and the front end part of the gear housing 107. Accordingly, the bellow-like member 108 is held in length D between the main body 103 and the housing portion 152. Further, as the auxiliary handle 190 is mounted on the auxiliary handle attachable portion 156 which is a part of the handle 109, the auxiliary handle 190 is also positioned in the rear position together with the handle 109.

On the other hand, as shown in FIG. 8 to FIG. 10, the handle 109 is positioned in a front position against the biasing force of the coil spring 160 in a state that the biasing force of the coil spring 160 is applied to the handle 109. In the front position, the housing portion 152 is disposed in distance D1 from the main body 103. The distance D1 is shorter than the distance D. The front position is defined by contact between contact portion 154*c* and the rear end part of the sliding guide 106. Accordingly, the bellow-like member 108 is held in length D1 between the main body 103 and the housing portion 152. At this time, the auxiliary handle 190 is positioned in the front position together with the handle 109.

The sliding guide 106 and the recess 154*a* are provided so as to extend parallel to the longitudinal direction of the hammer bit 119. The handle 109 is moved in a state that the sliding guide 106 of the motor housing 105 and the recess

154*a* of the handle rear side part 150 are engaged with each other, and thereby a moving direction of the handle 109 between the front position and the rear position is defined as being parallel to the longitudinal direction of the hammer bit 119. Further, the reinforcing ring 156*a* of the auxiliary handle attachable portion 156 is slid on the projection 107*c* of the gear housing 107 and thereby a moving direction of the auxiliary handle attachable portion 156 is defined as being parallel to the longitudinal direction of the hammer bit 119.

As described above, in a state that the handle 109 is biased by the coil spring 160, the handle 109 is reciprocally moved between the front position and the rear position by the vibration in the longitudinal direction of the hammer bit 119 during the operation. Thus, kinetic energy of the vibration is consumed by extension and contraction of the coil spring 160, and thereby vibration transmission from the main body 103 to the handle 109 is reduced.

The cooling air generated by the cooling fan 112 is exhausted from inside to outside the gear housing 107 via the opening 107*b*. Thereafter, the cooling air is flowed the cooling air passage 157A between the gear housing 107 and the extending portion 157. Further, the cooling air is passed along the outer surface of the metallic bearing holding portion 107*a* and then exhausted to outside of the hammer drill 101 via the through hole 159*b*. When the cooling air passes the metallic bearing holding portion 107*a*, the bearing 137*a* which is held by the bearing holding portion 107*a* is cooled. As shown in FIG. 3 and FIG. 10, the opening 107*b* is not closed (covered) by the handle 109 which is positioned not only in the front position but also in the rear position. Thus, an opening area of the opening 107*b* is not changed even when the handle 109 is moved. Accordingly, air flow rate of the cooling air is maintained.

As described above, the handle 109 is slid against the main body 103 during the operation. At this time, as the brush holder unit 171 is supported by the motor housing 105 of the main body 103, the lever 175 of the brush holder unit 171 and the handle 109 are relatively moved. Therefore, the opening 165 is formed on the handle 109 in order to avoid interference between the lever 175 and the handle 109 by the relative movement between the main body 103 and the handle 109, when the lever 175 is positioned corresponding to the forward rotational position or the reverse rotational position of the brush 170. The opening 165 is provided by a through hole formed on the handle 109 which extends in a moving direction of the lever 175 (vertical direction) which is perpendicular to the longitudinal direction of the hammer bit 119, as shown in FIG. 11.

Specifically, as shown in FIG. 11, the opening 165 is provided with a forward rotational region 165*a*, a reverse rotational region 165*b* and an intermediate region 165*c*. The forward rotational region 165*a* corresponds to the forward rotational position of the lever 175 which positions the brush 170 in the forward rotational position. Further, the reverse rotational region 165*c* corresponds to the reverse rotational position of the lever 175 which positions the brush 170 in the reverse rotational position. The forward rotational region 165*a* and the reverse rotational region 165*b* extend in the longitudinal direction of the hammer bit 119 such that the length of them are longer than the length of the intermediate region 165*c* in the longitudinal direction of the hammer bit 119. Therefore, as shown in FIG. 8, when the handle 109 is slid against the main body 103 during the operation, the lever 175 can be positioned within a rear region (right hand region in FIG. 8) of the forward rotational region 165*a* and thereby interference between the lever 175 and the handle 109 is avoided. Further, similar to the forward rotational region 165*a*, the lever 175 can be positioned within a rear region of the reverse rotational region 165*b* and thereby interference between the lever 175 and the handle 109 is also avoided. Each of the forward rotational region 165*a* and the reverse rotational region 165*b* is one example which corresponds to "an interference avoidance part" according to the present invention.

On the other hand, as shown in FIG. 11, when the lever 175 is positioned in the intermediate region 165*c*, the brush holder 172 prevents the trigger 109*a* from moving. Specifically, as shown in FIG. 12, the trigger 109*a* includes an engagement projection 109*b* which protrudes upward and toward the brush holder unit 171. When the lever 175 is positioned in the intermediate region 165*c*, a front end part of the brush holder 172 engages with a rear end part of the engagement projection 109*b*. Thereby, the brush holder 172 prevents the trigger 109*a* to be manipulated (pulled). That is, movement of the trigger 109*a* is prevented and thereby driving of the hammer drill 101 is prevented. At this time, the lever 175 engages with the front opening edge or the rear opening edge of the intermediate region 165*c* of the opening 165, and thereby the handle 109 is prevented from sliding against the main body 103. Each front or rear opening edge of the intermediate region 165*c* is one example which corresponds to "an engagement part" according to the present invention.

Figure 15:
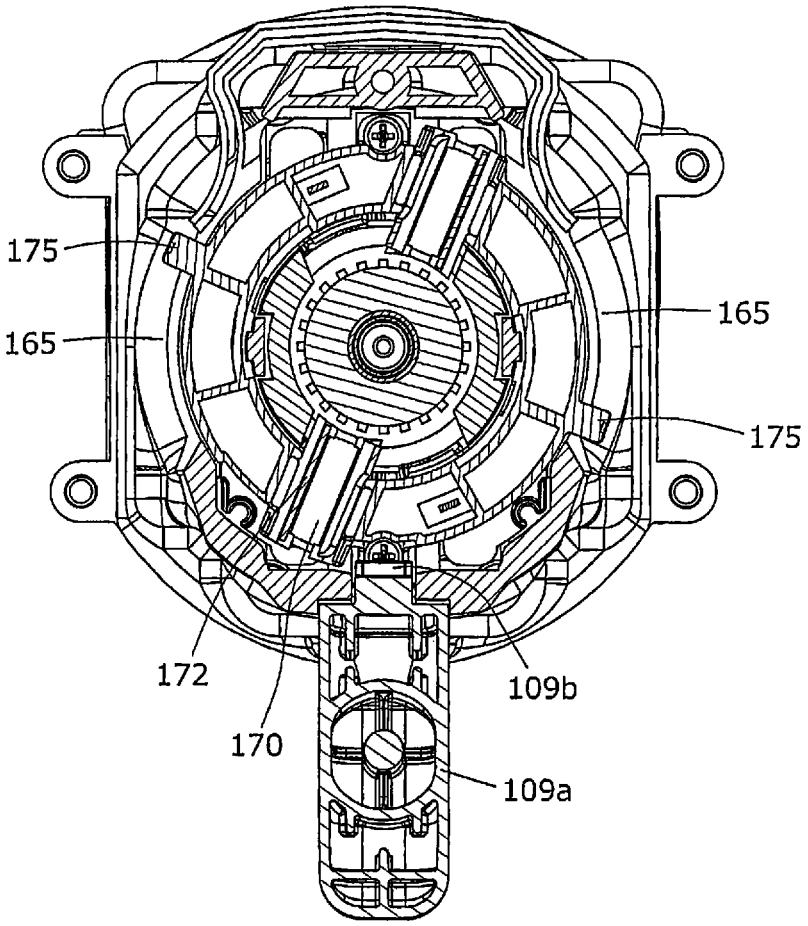
FIG. 15 shows a cross sectional view taken along the XV-XV line in FIG. 14.
Figure 16:
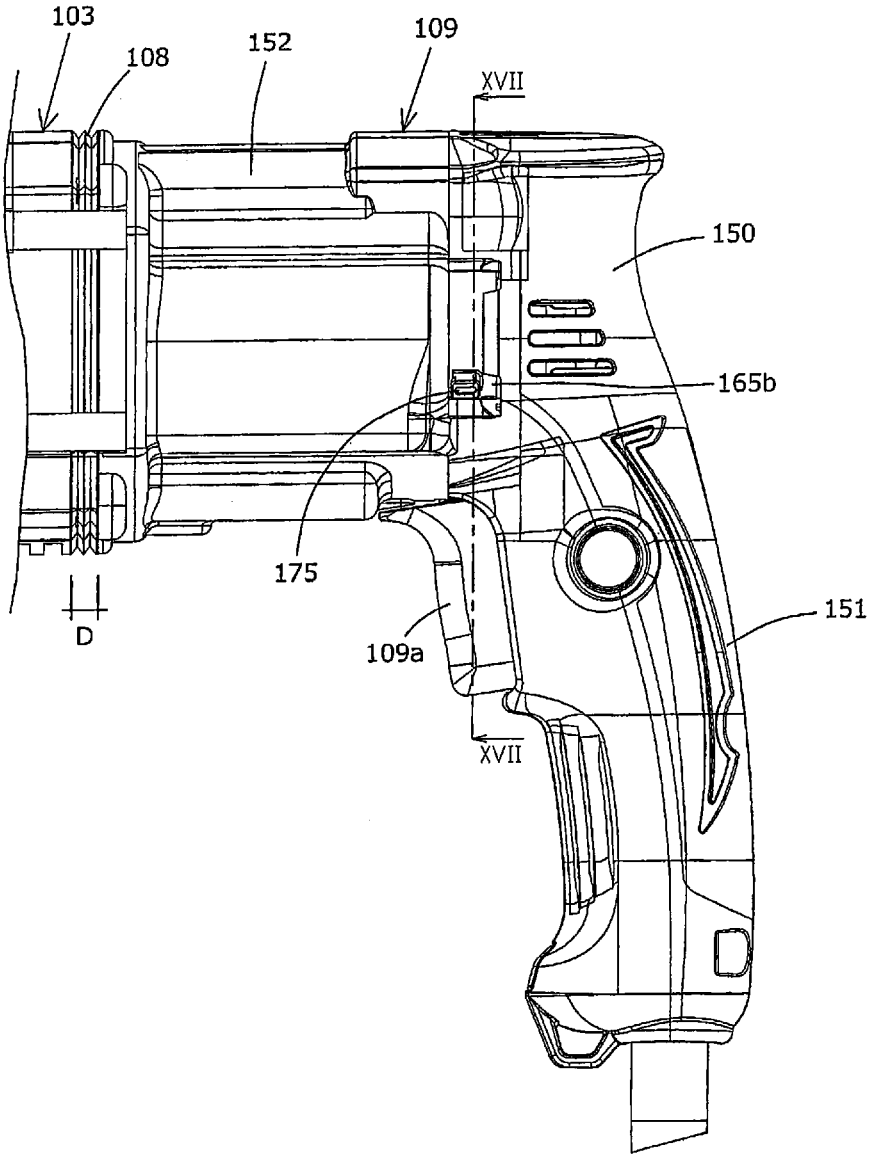
FIG. 16 shows an enlarged side view of the handle in which the lever is located corresponding to a reverse driving of the motor.
Figure 17:
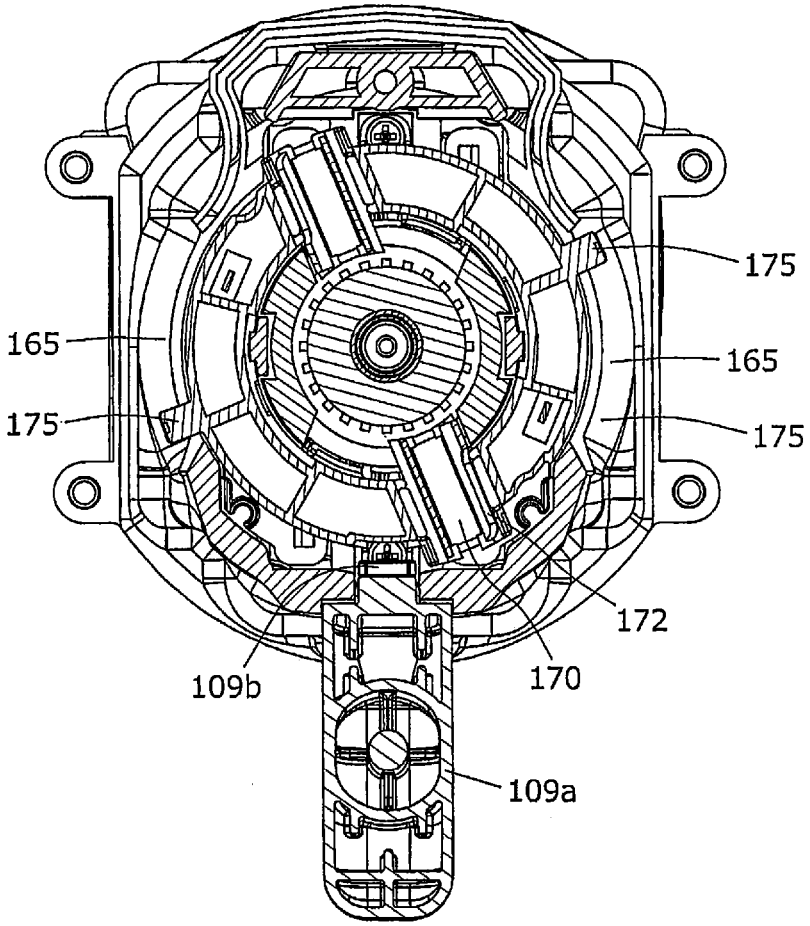
FIG. 17 shows a cross sectional view taken along the XVII-XVII line in FIG. 16.

Further, as shown in FIG. 15 and FIG. 17, when the lever 175 is positioned in the forward rotational region 165*a* or in the reverse rotational region 165*b*, the engagement projection 109*b* of the trigger 109*a* is unengageable with the brush holder 172. Accordingly, manipulation of the trigger 109*a* is allowed and thereby the hammer drill 101 is drivable. When the trigger 109*a* is manipulated and positioned in its rear position, a side part of the engagement projection 109*b* of the trigger 109*a* engages with a side part of the brush holder 172 and thereby rotation of the brush holder unit 171 is prevented. As a result, when the driving motor 111 is driving, the brush 170 is prevented from moving from the forward rotational position or the reverse rotational position, in other words, the brush 170 is held in the predetermined position (optimum position).

As described above, when the lever 175 is positioned in the intermediate region 165*c* which is different from the optimum positions of the brush 170 for driving the driving motor 111, the driving of the hammer drill 101 is prevented. On the other hand, when the lever 175 is positioned within the forward rotational region 165*a* or the reverse rotational region 165*b* as optimum position which respectively positions the brush 170 in the forward rotational position or the reverse rotational position for driving the driving motor 111, the driving of the hammer drill 101 is allowed and interference between the lever 175 and the handle 109 is avoided. The position of the lever 175 which positions the brush 170 in the forward rotational position is one example which corresponds to "a first position" according to the present invention. Further, the position of the lever 175 which positions the brush 170 in the reverse rotational position is one example which corresponds to "a second position" according to the present invention.

According to the first embodiment described above, when the brush 170 is positioned in the neutral position, the brush holder unit 171 engages with the trigger 109*a*. As a result the driving of the hammer drill 101 is prevented. The brush holder unit 171 has not only a function in which the brush holder unit 171 holds the brush 170 and switches the position of the brush 170 but also another function in which the brush holder unit 171 prevents the hammer drill 101 from driving when the brush 170 is positioned in other than the optimum positions.

Further, in a state that the brush 170 is positioned in the forward rotational position or in the reverse rotational position, after the trigger 109*a* is pulled and the hammer drill 101 is driven, the engagement projection 109*b* of the trigger 109*a* prevents the brush holder unit 171 from rotating. Accordingly, when the driving motor 111 is driving, the brush 170 is positioned and held in the optimum position.

(Second Embodiment)

Next, a second embodiment of the present invention is explained with reference to FIG. 18 to FIG. 22. In the second embodiment, as shown in FIG. 19, a trigger moving preventing member 180 is provided below the brush holder unit 171. Except for the trigger moving preventing member 180, components of the hammer drill 101 are the same as that of the first embodiment, and therefore the same reference numerals are assigned and the explanation of the components is omitted.

Figure 18:
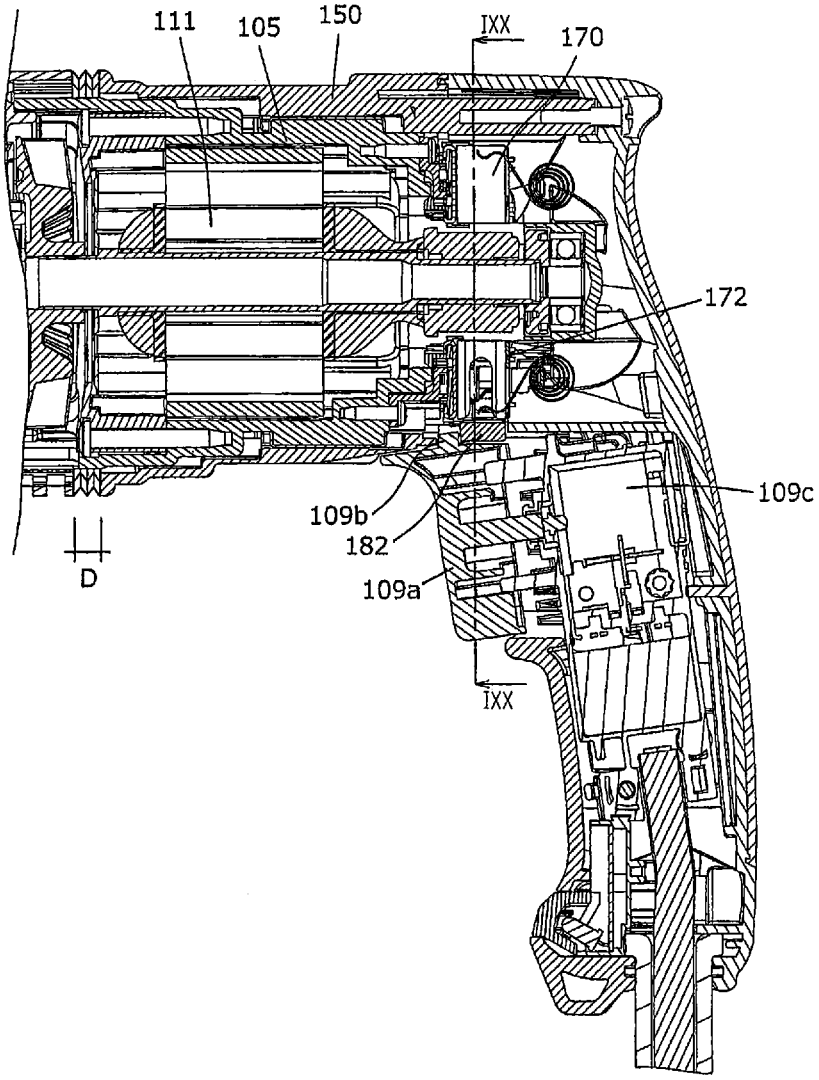
FIG. 18 shows an enlarged cross sectional view of a handle according to a second embodiment of the present invention.
Figure 19:
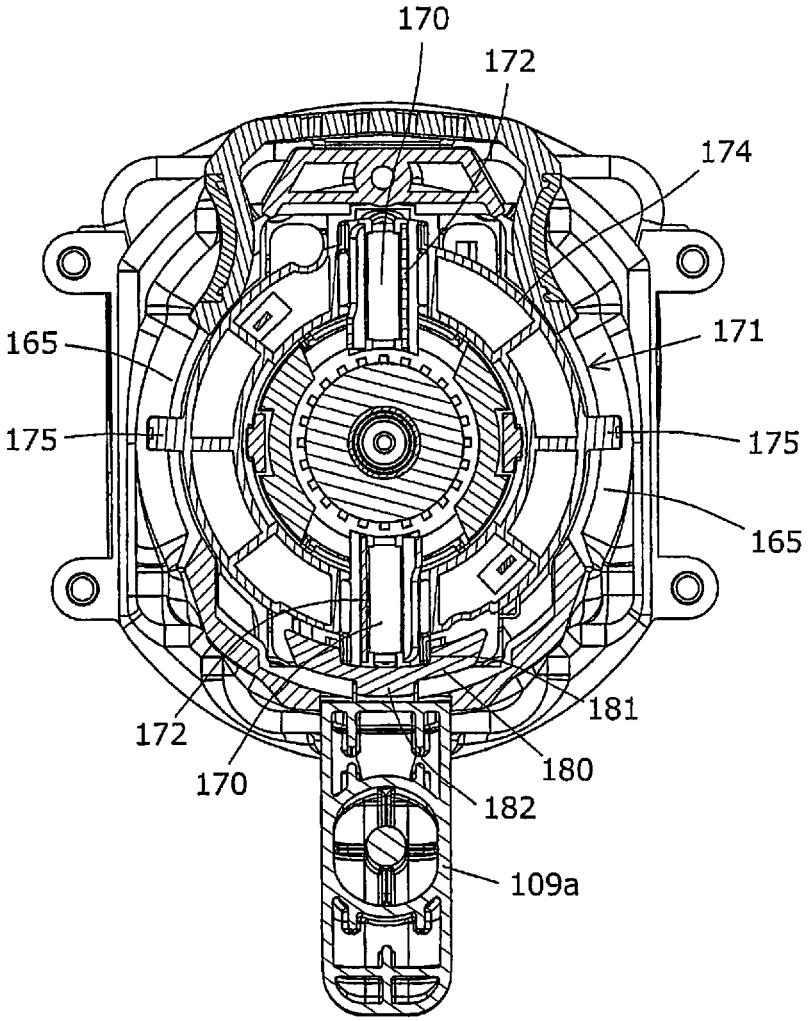
FIG. 19 shows a cross sectional view taken along the XIX-XIX line in FIG. 18.

As shown in FIG. 18 and FIG. 19, the trigger moving preventing member 180 is arranged between the trigger 109*a* and the brush holder unit 171 and supported on the handle rear part 150 of the handle 109. Specifically, the trigger moving preventing member 180 is supported in a relatively rotatable manner around the longitudinal direction of the hammer bit 119 against the handle rear part 150. Accordingly, the trigger moving preventing member 180 is configured to rotate around a rotational axis of the brush holder unit 171. Further, the trigger moving preventing member 180 is supported in a relatively unmovable manner in the longitudinal direction of the hammer bit 119 against the handle rear part 150. Accordingly, the trigger moving preventing member 180 is configured to move integrally with the handle rear part 150. The trigger moving preventing member 180 is one example which corresponds to "an intervening member" according to the present invention.

As shown in FIG. 19, the trigger moving preventing member 180 includes an engagement recess 181 and an engagement projection 182. The engagement recess 181 is provided on the upper surface of the trigger moving preventing member 180 so as to face the brush holder 172 and the engagement recess 181 is engageable with the brush holder 172. Further, the engagement projection 182 is provided below the engagement recess 181 on the lower surface of the trigger moving preventing member 180.

As shown in FIG. 18 and FIG. 19, when the lever 175 is positioned corresponding to the neutral position of the brush 170, the engagement projection 182 protrudes downward. That is, the engagement projection 182 is arranged such that the front side edge of the engagement projection 182 can be engaged with the rear side edge of the engagement projection 109*b* of the trigger 109*a*. As the trigger moving preventing member 180 is unmovable in the longitudinal direction of the hammer bit 119 against the handle rear part 150, the engagement projection 182 engages with the engagement projection 109*b* and thereby rearward movement of the trigger 109*a* is prevented. Namely, operation of the trigger 109*a* is prevented. As a result, driving of the hammer drill 101 is prevented. At this time, the lever 175 engages with the front opening edge or the rear opening edge of the intermediate region 165*c* of the opening 165, and thereby sliding of the handle 109 with respect to the main body 103 is prevented. Each of the front opening edge and the rear opening edge of the intermediate region 165*c* is one example which corresponds to "an engagement part" according to the present invention.

Figure 20:
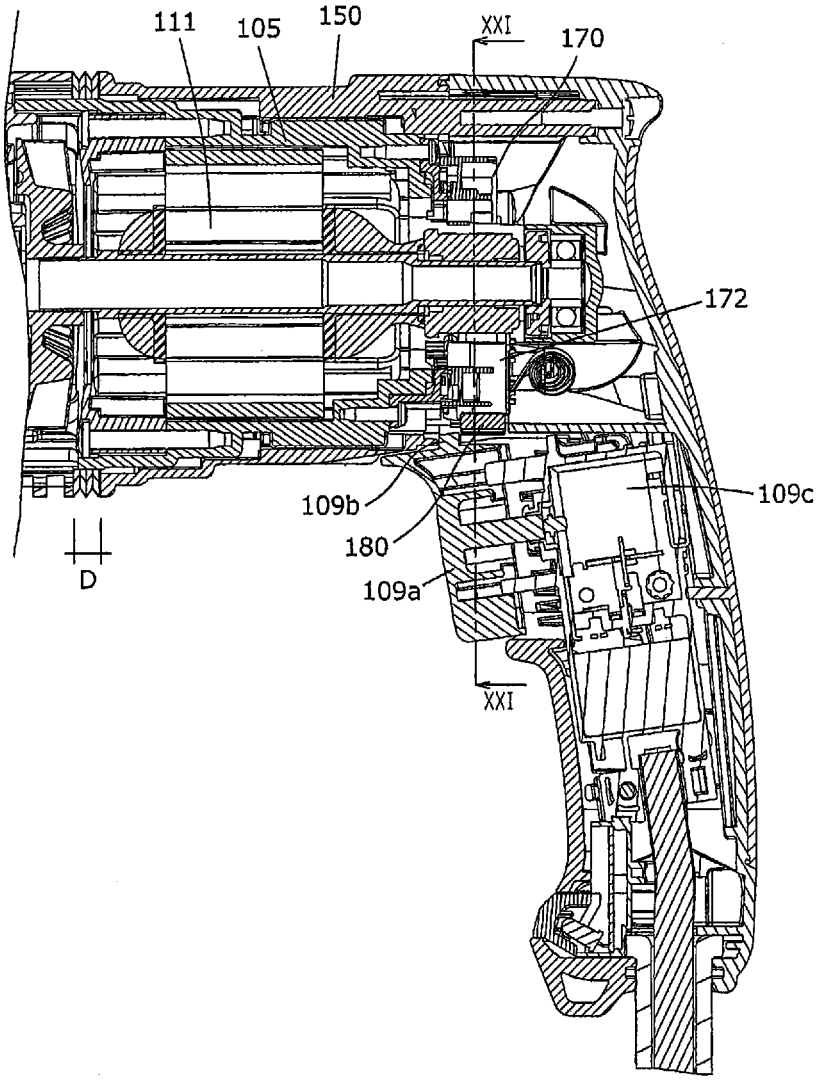
FIG. 20 shows a cross sectional view of the handle in which a lever is located corresponding to a reverse driving of the motor.
Figure 21:
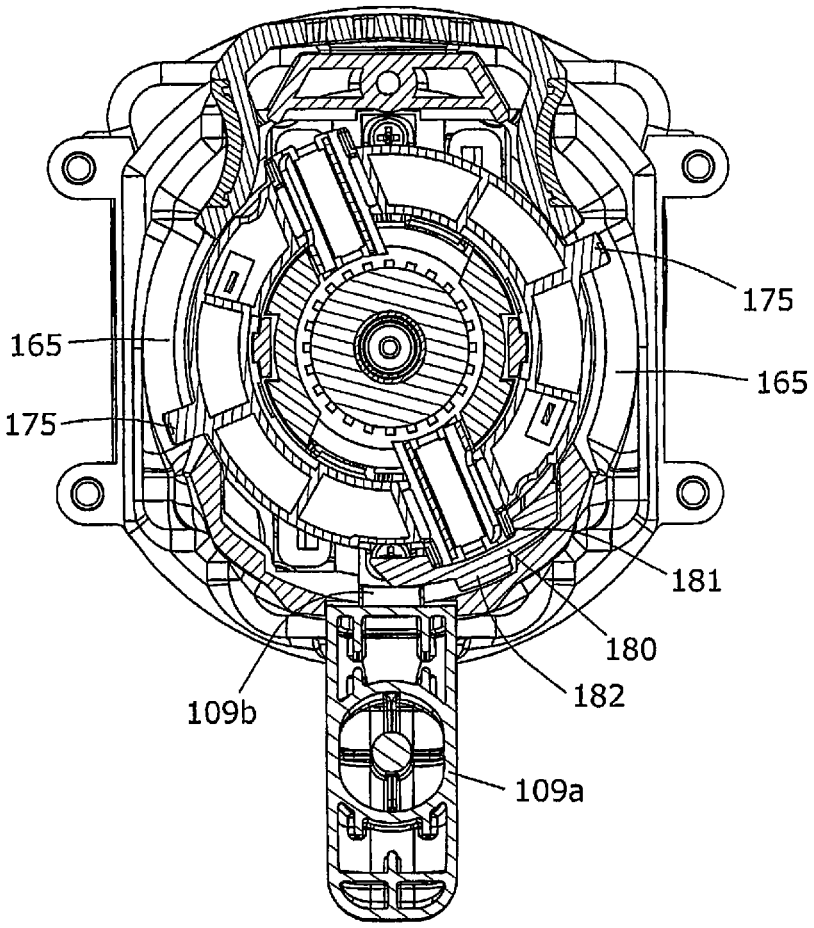
FIG. 21 shows a cross sectional view taken along the IXX-IXX line in FIG. 20.
Figure 22:
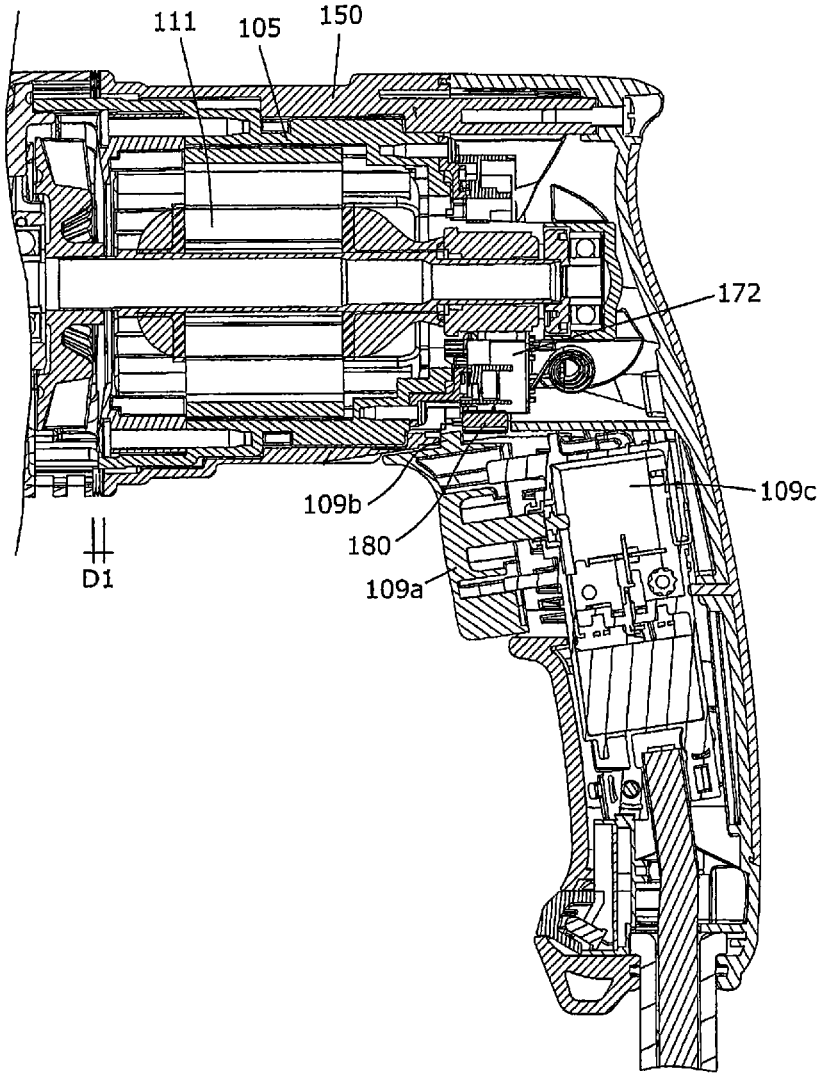
FIG. 22 shows a cross sectional view in which the handle is located in its front position.

As shown in FIG. 20 and FIG. 21, when the lever 175 is manipulated and the brush holder unit 171 is rotated, the trigger moving preventing member 180 is rotated integrally with the brush holder unit 171 while the brush holder 172 engages with the engagement recess 181. When the lever 175 is positioned corresponding to the predetermined position of the brush 170 for driving the driving motor 111, where the position illustrated in FIG. 20 and FIG. 21 corresponds to the reverse rotational position, the engagement projection 182 is deviated from a line passing the trigger 109*a* and the rotational axis of the driving motor 111. Thereby, the rear side edge of the engagement projection 109*b* of the trigger 109*a* is to be unengageable with the front side edge of the engagement projection 182 of the trigger moving preventing member 180, and movement of the trigger is allowed. That is, operation of the trigger 109*a* is allowed, and when the trigger is operated by a user, the hammer drill 101 is driven.

When the hammer drill 101 is driven and the predetermined operation is performed, vibration is occurred on the main body 103 during the operation. At this time, the handle 109 slides against the motor housing 105 of the main body 103, in other words, the handle 109 moves between a rear position shown in FIG. 20 and a front position shown in FIG. 22. As similar to the first embodiment, the lever 175 is positioned within the forward rotational region 165*a* or the reverse rotational region 165*b* and thereby interference between the lever 175 and the handle 109 is avoided by the forward rotational region 165*a* or the reverse rotational region of the opening 165.

When the trigger 109*a* is manipulated and positioned in the rear position, the driving motor 111 is driven. At this time, the side edge of the engagement projection 109*b* of the trigger 109*a* and the side edge of the engagement projection 182 of the trigger moving preventing member 180 are engaged with each other, and thereby the trigger moving preventing member is prevented from moving around the rotational axis of the brush holder unit 171. That is, rotation of the brush holder unit 171 is prevented. Accordingly, the brush 170 is held in the optimum position when the driving motor 111 is driving.

In the first embodiment, when the trigger 109*a* is manipulated, the side edge of the engagement projection 109*b* of the trigger 109*a* engages with the side edge of the brush holder 172 and thereby rotation of the brush holder unit 171 is prevented. As the brush holder 172 which is engaged with the trigger 109*a* is held by the main body 103, the brush holder 172 is moved in longitudinal direction of the hammer bit 119 with respect to the trigger 109*a*. On the other hand, in the second embodiment, the trigger moving preventing member 180 which is engaged with the trigger 109*a* is held by the handle 109. Accordingly, when the trigger 109*a* is manipulated, even if the handle 109 is moved in the longitudinal direction of the hammer bit 119 with respect to the main body 103, the trigger moving preventing member 180 is not moved with respect to the trigger 109*a*. Thus, the brush 170 is stably held in the optimum position when the driving motor 111 is driving by an engagement between the trigger 109*a* and the trigger moving preventing member 180.

According to the second embodiment described above, when the brush 170 is positioned (located) in the neutral position, the trigger moving preventing member 180 prevents the trigger 109 from moving. That is, manipulation of the trigger 109*a* is prevented and thereby driving of the hammer drill 101 is prevented. Further, in a state that the brush 170 is positioned (located) in the forward rotational position or the reverse rotational position, after the trigger

109*a* is manipulated and the hammer drill 101 is driven, the engagement projection 109*b* of the trigger 109*a* engages with the engagement projection 182 of the trigger moving preventing member 180 and thereby rotation of the brush holder unit 171 is prevented. Accordingly, the brush 170 is held in the optimum position (forward/reverse rotational position) when the driving motor 111 is driving.

In the second embodiment, the trigger moving preventing member 180 is supported by the handle rear part 150 of the handle 109. However, the trigger moving preventing member 180 may be supported by the trigger switch 109*c* which is fixed on the handle rear part 150.

According to the first and the second embodiments described above, the sliding guide 106 guides the handle 109 in the longitudinal direction of the hammer bit 119. Accordingly, in the hammer drill 101 in which vibration mainly in the longitudinal direction of the hammer bit 119 is occurred, since a main direction of the vibration and the moving direction of the handle 109 are in conformity to each other, vibration transmission to the handle 109 is effectively reduced. Further, the driving motor 111 is housed in the motor housing 105 of the main body 103, therefore the lightweight handle 109 is provided. As a result, vibration of the handle 109 is effectively reduced without increasing a consumption amount of kinetic energy of the vibration by the coil spring 160. Further, a distance between the driving motor 111 and the motion converting mechanism 113 as well as the rotation transmission mechanism 117 is maintained constant. Accordingly, a specially formed transmitting member which is not widely or generally used member such as a bellow-like transmitting member for transmitting rotation of the driving motor 111 to the motion converting mechanism 113 or the rotation transmission mechanism 117 is not needed.

Further, according to the first and the second embodiments, a plurality of sliding guide 106 are arranged around the longitudinal direction of the hammer bit 119. Thus, the handle 109 is prevented from moving in a direction other than the longitudinal direction of the hammer bit 119. That is, the handle 109 is moved only in the longitudinal direction of the hammer bit 119. As a result, usability of the hammer drill 101 in which the handle 109 is moved against the main body 103 is improved.

Further, according to the first and the second embodiments, the handle 106 is guided by the metallic sliding guide 106 and the resin recess 154*a*. When the handle 109 is moved, a sliding between different materials is occurred. Accordingly, sliding resistance between the sliding guide 106 and the recess 154*a* is decreased, and thereby the handle 109 is smoothly moved. As a result, vibration transmission to the handle 109 is effectively reduced.

Further, according to the first and the second embodiments, the handle rear side part 150 and the handle front side part 155 are moved integrally. Therefore, a distance between the grip portion 151 of the handle rear side part 150 and the auxiliary handle 190 which is attached to the auxiliary handle attachable portion 156 of the handle front side part 155 is maintained constant. Accordingly, usability for a user holding the grip portion 151 and the auxiliary handle 190 is improved.

Further, according to the first and the second embodiments, the extending portion 157 connects the auxiliary handle attachable portion 156 with the housing portion 152 and further forms the cooling air passage 157A. Therefore, another member providing a cooling air passage for cooling the bearing 137*a* which holds the tool holder 137 is not necessary. Accordingly, number of members of the hammer drill 101 is reduced.

Further, according to the first and the second embodiments, a plurality of coil springs 160 are arranged around the longitudinal direction of the hammer bit 119. Thus, the handle 109 is stably biased by the springs 160. As a result, vibration transmission to the handle 109 is effectively reduced by the plurality of springs 160.

Further, according to the first and the second embodiments, coil springs 160 and sliding guides 106 are arranged in the same region with respect to the longitudinal direction of the hammer bit 119. Further, the coil springs 160 and the sliding guides 106 are arranged at respective positions which are different to each other with respect to the circumference direction around the hammer bit 119. Accordingly, outer space of the driving motor 111 is rationally utilized.

Further, according to the first and the second embodiments, the cooling air flows between the auxiliary handle attachable portion 156 and the gear housing 107. Accordingly, heat generated by a relative sliding of the auxiliary handle attachable portion 156 to the gear housing 107 is effectively discharged to the air.

Further, according to the first and the second embodiments, when the handle 109 slides against the main body 103, interference between the handle 109 and the lever 175 of the brush holder unit 171 which is held by the main body 103 is avoided.

In the first and the second embodiments, the opening 165 is formed on the handle 109, however it is not limited to such a construction. For example, the handle rear part 155 may have a recess which extends in the longitudinal direction of the hammer bit 119 at its front end part, and the lever 175 may be located within the recess. In other word, the opening may preferably include hole, recess and so on.

Further, in the first and the second embodiments, the positive side brush and the negative side brush are rotated integrally with each other by the brush holder 172 and the rotatable body 174. However, the positive side brush and the negative side brush may be separately rotated. Further, at least one of the positive and the negative side brushes may be rotated.

In the embodiment described above, the coil spring 160 is disposed as a biasing member, however other kind of spring or a rubber like that may be applied to the present invention. Further, the sliding guide 106 may be formed by resin and the recess 154*a* may be formed by metal. Further, the power tool according to the present invention is not limited to the hammer drill 101. That is, an electric hammer or a reciprocating saw may be applied to the present invention as a power tool, as long as a power tool generates vibration in a predetermined longitudinal direction.

Having regard to an aspect of the invention, following features are provided. Each feature may be utilized independently or in conjunction with other feature (s) or claimed invention (s).

(Feature 1)

The interference avoidance part is provided by a first through-hole which is formed on the main handle, the through-hole having (1) a first interference avoidance part which avoids interference between the main handle and the switching member is located in the first position, and (2) a second interference avoidance part which avoids interference between the main handle and the switching member located in the second position, and the engagement part is provided by an opening edge of a second through-hole which is formed on the main handle, and the first through-hole and the second through-hole are connected to each other, and switching member is configured to move through both of the first through-hole and the second through-hole.

(Feature 2)

The second preventing portion is provided by the opening edge of the first through-hole.

(Feature 3)

The length of the first through-hole in the longitudinal direction of the tool bit is longer than the length of the second through-hole.

(Feature 4)

The first through-hole is configured to extend in the longitudinal direction of the tool bit, and the second through-hole is configured to extend in a direction crossing the longitudinal direction of the tool bit.

(Feature 5)

When the switching member is located in the intermediated position between the first position and the second position, the moving preventing part engages with the trigger and prevents the trigger from being operated.

(Feature 6)

The switching member has a substantially circular cross section, and the switching member is configured to rotate around an center axis of the circular cross section and the position of the switching member is switched between the first position and the second position.

(Feature 7)

The intervening member is supported such that the intervening member is rotatable integrally with the switching member against the main handle around the longitudinal direction of the tool bit and the intervening member is unmovable against the main handle in the longitudinal direction of the tool bit.

(Feature 8)

The brush is provided with a positive side brush and a negative side brush, and the switching member is configured to hold the positive and the negative side brushes such that the brushes rotate integrally with each other.

(Feature 9)

The brush is provided with a positive side brush and a negative side brush, and the switching member is configured to switch a position of one brush among the positive side brush and the negative side brush.

(Feature 10)

The switching member is provided with a brush holding portion which holds the brush, an operated portion which is connected to the brush holding portion and is manually operated by a user, and a fixed portion which is fixed on the main body, and the fixed portion is configured to support the brush holding portion in a rotatable manner and the brush holding portion is rotatable with respect to the main body.

(Feature 11)

A power tool which drives a tool bit in a longitudinal direction of the tool bit and performs an operation, comprising:

a motor which has an output shaft being parallel to the longitudinal direction of the tool bit, a driving mechanism which is connected to the output shaft and driven by the motor, a main body which houses the motor and the driving mechanism, a main handle which is movable with respect to the main body, a guide element which guides the main handle such that the main handle moves in the longitudinal direction of the tool bit with respect to the main body, and a biasing member which is arranged between the main body and the main handle and biases the main body and the main handle in the longitudinal direction of the tool bit, wherein the main handle moves against the main body in a state that the main handle is biased by the biasing member, and transmission of vibration generated during the operation from the main body to the main handle is prevented.

(Feature 12)

The switching member is configured to move within the recess in the longitudinal direction and interference between the switching member and the main handle is avoided by the recess.

(Feature 13)

The switching member includes a projection which protrudes the recess of the main handle, the projection moving in the longitudinal direction of the tool bit when the main handle is moved in the longitudinal direction with respect to the main body, and, the recess has a length in the longitudinal direction such that the projection of the switching member is prevented from contacting with an edge of the recess in the longitudinal direction.

(Feature 14)

The recess is provided by a through-hole which is formed on the main handle.

A correspondence relation between each components of the embodiments and features of the invention is explained as follows. Further, each embodiment is one example to utilize the invention therefore the invention is not limited to the embodiments.

The hammer drill 101 corresponds to "a power tool" of the invention.

The driving motor 111 corresponds to "a motor" of the invention.

The brush 170 corresponds to "a brush" of the invention.

The brush holder unit 171 corresponds to "a switching member" of the invention.

The brush holder 172 corresponds to "a brush holding part" of the invention.

The rotatable body 174 corresponds to "a brush holding part" of the invention.

The lever 175 corresponds to "an operated part" of the invention.

The motion converting mechanism 113 corresponds to "a driving mechanism" of the invention.

The hammering element 115 corresponds to "a driving mechanism" of the invention.

The rotation transmission mechanism 117 corresponds to "a driving mechanism" of the invention.

The main body 103 corresponds to "a main body" of the invention.

The motor housing 105 corresponds to "a main body" of the invention.

The gear housing 107 corresponds to "a main body" of the invention.

The handle 109 corresponds to "a main handle" of the invention.

The trigger **109*a*** corresponds to "a trigger" of the invention.

The trigger switch 109*c* corresponds to "a trigger switch" of the invention.

The engagement projection 109*b* corresponds to "a moving preventing part" of the invention.

The engagement projection 109*b* corresponds to "a first preventing portion" of the invention.

The coil spring 160 corresponds to "a biasing member" of the invention.

The forward rotational region 165*a* corresponds to "an interference avoidance part" of the invention.

The reverse rotational region 165*b* corresponds to "an interference avoidance part" of the invention.

The trigger moving preventing member 180 corresponds to "an intervening member" of the invention.

The trigger moving preventing member 180 corresponds to "a moving preventing part" of the invention.

DESCRIPTION OF NUMERALS

101 hammer drill
103 main body
105 motor housing
106 sliding guide
107 gear housing
107*a* bearing holding portion
107*b* opening
107*c* projection
108 bellow-like member
109 handle
109*a* trigger
109*b* engagement projection
110 mode select switch
111 driving motor
112 cooling fan
113 motion converting mechanism
115 hammering element
117 rotation transmission mechanism
119 hammer bit
125 intermediate shaft
127 rotatable body
129 swing member
131 cylindrical piston
131*a* air chamber
133 small diameter gear
135 large diameter gear
137 tool holder
137*a* bearing
143 striker
145 impact bolt
150 handle rear side part
151 grip portion
152 housing portion
153 engagement projection
154*a* recess
154*b* pressing portion
154*c* contact portion
155 handle front side part
156 auxiliary handle attachable portion
156*a* reinforcing ring
157 extending portion
157A cooling air passage
158 engagement recess
159*a* contact portion
159*b* through hole
160 coil spring
165 opening
165*a* forward rotational region
165*b* reverse rotational region
165*c* intermediate region
170 brush
171 brush holder unit
172 brush holder
173 spring
174 rotatable body
175 lever
176 supporting body
180 trigger moving preventing member
181 engagement recess
182 engagement projection
190 auxiliary handle
191 holding portion
192 grip
193 flange
194 bolt
195 attaching portion
196 engagement band
197 nut
198 band holding portion

What is claimed is:

1. A power tool which drives a tool bit in a longitudinal direction of the tool bit and performs an operation, comprising:

a driving mechanism which drives the tool bit, a motor which has a brush and drives the driving mechanism, a position of the brush being selectively switched in a first rotational position in which a rotational shaft of the motor rotates in a predetermined first direction and a second rotational position in which the rotational shaft of the motor rotates in a second direction opposite to the first direction, a switching member which is manually operated by a user for switching the position of the brush and is movable between a first position which positions the brush in the first rotational position and a second position which positions the brush in the second rotational position, a main body which holds the driving mechanism, the motor and the switching member, and a main handle which is biased by a biasing member in the longitudinal direction of the tool bit, which is arranged between the main body and the main handle, and the main handle is relatively movable with respect to the main body in a state that the biasing member biases the main handle, and the vibration caused on the main body during the operation is prevented from being transmitted to the main handle, wherein the main handle includes an interference avoidance part which avoids interference between the switching member and the main handle when the switching member is positioned in the first position or the second position and the main handle is moved with respect to the main body.

2. The power tool according to claim 1, wherein the first position and the second position are defined as each position in a crossing direction crossing the longitudinal direction of the tool bit and the switching member is configured to move in the crossing direction, and wherein the main handle is configured to move in the longitudinal direction of the tool bit with respect to the main body and the main handle has an engagement part which is engageable with the switching member positioned in an intermediate position between the first position and the second position, and wherein the main handle is prevented from moving in the longitudinal direction of the tool bit with respect to the main body by an engagement of the switching member and the engagement part.

3. The power tool according to claim 1, further comprising a moving preventing part which prevents the switching member from moving to an intermediate position between the first position and the second position when the switching member is positioned in the first position or the second position and the motor is turned on.

4. The power tool according to claim 3, further comprising a trigger which is manually operated by a user for driving the motor, wherein the main handle is configured to move between a proximal position which is proximal to the tool bit and a separated position which is separated from the proximal position in the longitudinal direction of the tool bit and the main handle is biased by the biasing member toward the separated position in the longitudinal direction of the tool bit, and wherein the moving preventing part is provided with a first preventing portion which is arranged on the trigger and a second preventing portion which is arranged on the main handle, in a state that the motor is driven by manipulation of the trigger, (i) when the main handle is positioned in the proximal position, the second preventing portion engages with the switching member and prevents the switching member from moving to the intermediate position, and (ii) when the main handle is positioned in the separated position, the first preventing portion engages with the switching member and prevents the switching member from moving to the intermediate position.

5. The power tool according to claim 3, further comprising a trigger which is manually operated by a user for driving the motor, and an intervening member which is arranged between the trigger and the switching member, the intervening member being engageable with the trigger and the switching member respectively, wherein the moving preventing part is provided by the intervening member.

6. The power tool according to claim 5, further comprising a trigger switch which is fixed on the main handle and operated by the trigger, wherein the intervening member is supported by the main handle and/or the trigger switch, and wherein the intervening member is configured to move integrally with the switching member in a direction crossing the longitudinal direction of the tool bit by engaging with the switching member moving between the first position and the second position, and the intervening member is configured to move with respect to the switching member in the longitudinal direction of the tool bit together with a relative movement between the main body and the main handle.

7. The power tool according to claim 1, wherein the switching member comprises a brush holding part which holds the brush, the brush holding part being movable around a rotational axis of the motor, and an operated part which is connected to the brush holder, the operated part being manually operated by a user, and wherein the operated part is provided such that the operated part protrudes from the brush holding part in a direction perpendicular to the rotational axis of the motor.

8. The power tool according to claim 7, wherein the interference avoidance part is provided with a through hole which is formed on the main handle, and wherein the operated part is exposed to the outside of the power tool by extending through the through hole.

9. The power tool according to claim 8, wherein the through hole as the interference avoidance part is provided with a first interference avoidance part which extends in the longitudinal direction of the tool bit for avoiding interference between the switching member located in the first position and the main handle and a second interference avoidance part which extends in the longitudinal direction of the tool bit for avoiding interference between the switching member located in the second position and the main handle, and wherein the first interference avoidance part and the second interference avoidance part are connected to each other.

10. The power tool according to claim 1, wherein the interference avoidance part avoids interference between the switching member and the main handle when the main handle is moved with respect to the main body and the switching member, and the main handle is relatively movable with respect to the main body and the switching member in a state that the biasing member biases the main handle.

11. A power tool which drives a tool bit in a longitudinal direction of the tool bit and performs an operation, comprising:

a driving mechanism which drives the tool bit, a motor which has a brush and drives the driving mechanism, a position of the brush being selectively switched in a first rotational position in which a rotational shaft of the motor rotates in a predetermined first direction and a second rotational position in which the rotational shaft of the motor rotates in a second direction opposite to the first direction, a switching member which is manually operated by a user for switching the position of the brush and is movable between a first position which positions the brush in the first rotational position and a second position which positions the brush in the second rotational position, a main body which holds the driving mechanism, the motor and the switching member, and a main handle which is biased by a biasing member in the longitudinal direction of the tool bit, which is arranged between the main body and the main handle, and the main handle is relatively movable with respect to the main body in a state that the biasing member biases the main handle, and the vibration caused on the main body during the operation is prevented from being transmitted to the main handle, wherein:

the main handle houses the switching member which is held by the main body, and includes an opening which is formed to face the switching member, the switching member includes an operated part which protrudes at least to an inside of the opening and which is manually operable from outside the main handle, the opening includes a first portion in which the operated part is disposed when the switching member is positioned in the first position, and a second portion in which the operated part is disposed when the switching member is positioned in the second position, and at least the first portion and the second portion of the opening each have a width in the longitudinal direction, the width being greater than a width of a portion of the operated part disposed in the opening, and allowing the operated part to move in the first part or the second part in the longitudinal direction of the tool bit when the main handle is moved with respect to the main body and the switching member.

12. The power tool according to claim 11, wherein the opening extends in a crossing direction crossing the longitudinal direction of the tool bit, and further includes a third portion in which the operated part is disposed when the switching member is positioned at an intermediate position between the first position and the second position, the first portion and the second portion connect to both ends of the third portion in the crossing direction, and the third portion has a width in the longitudinal direction that is generally same with the width of the portion of the operated part disposed in the opening and that is smaller than the width of the first portion and the width of the second portion.

* * * * *